US010094187B2

(12) United States Patent
Ferrari

(10) Patent No.: US 10,094,187 B2
(45) Date of Patent: Oct. 9, 2018

(54) COLLECTOR CIRCUIT FOR DRILLING FLUID CIRCULATION SYSTEM AND METHOD FOR DIVERTING THE CIRCULATION OF THE FLUID

(71) Applicant: DRILLMEC SPA, Gariga di Podenzano (PC) (IT)

(72) Inventor: Stefano Ferrari, Barbiano (IT)

(73) Assignee: DRILLMEC S.P.A., Gariga di Podenzano (PC) (IT)

( * ) Notice: Subject to any disclaimer, the term of this patent is extended or adjusted under 35 U.S.C. 154(b) by 143 days.

(21) Appl. No.: 15/112,117

(22) PCT Filed: Jan. 12, 2015

(86) PCT No.: PCT/IB2015/050223

§ 371 (c)(1),
(2) Date: Jul. 15, 2016

(87) PCT Pub. No.: WO2015/107447

PCT Pub. Date: Jul. 23, 2015

(65) Prior Publication Data

US 2016/0340990 A1 Nov. 24, 2016

(30) Foreign Application Priority Data

Jan. 16, 2014 (IT) ..... TO2014A0024

(51) Int. Cl.
*E21B 21/10* (2006.01)
*E21B 21/08* (2006.01)
*E21B 21/015* (2006.01)

(52) U.S. Cl.
CPC ..... *E21B 21/106* (2013.01); *E21B 21/015* (2013.01); *E21B 21/08* (2013.01); *E21B 21/10* (2013.01)

(58) Field of Classification Search
CPC ..... E21B 21/106; E21B 21/10
See application file for complete search history.

(56) References Cited

U.S. PATENT DOCUMENTS 3,477,526 A * 11/1969 Baugh ..... E21B 21/08 175/218
2004/0178003 A1 9/2004 Riet
(Continued)

FOREIGN PATENT DOCUMENTS

AU 2009101354 A4 9/2011
WO 2011/050500 A1 5/2011

OTHER PUBLICATIONS

International Search Report and Written Opinion dated from corresponding International Patent Application No. PCT/IB2015/050223, dated Mar. 17, 2015.

*Primary Examiner* — Shane Bomar
(74) *Attorney, Agent, or Firm* — Merchant & Gould P.C.

(57) ABSTRACT

A collector circuit and associated circulation process, for intercepting and selectively diverting, at least partially, a fluid flow continuously flowing in a fluid circulation system, for drilling rigs. The collector includes a first sub-circuit with a first duct, with a first valve, and a second duct with a second valve; and; a second sub-circuit; The first sub-circuit, depending on the operating configurations of the first valve and the second valve, is adapted to allow the transit of the fluid flow in the first duct, and selectively divert fluid flow towards the second duct. The second sub-circuit is fluid-dynamically connected to the second duct of the first sub-circuit for receiving fluid flow, diverted by the first sub-circuit, and directing it towards a first outlet of the second sub-circuit. The second sub-circuit and the first sub-circuit are independent, and the second sub-circuit is removable from the collector circuit.

14 Claims, 15 Drawing Sheets

(56) References Cited

U.S. PATENT DOCUMENTS

| | | | | |
|---|---|---|---|---|
| 2007/0227774 | A1 | 10/2007 | Reitsma et al. | |
| 2010/0084142 | A1* | 4/2010 | Calderoni | A61K 31/385 166/380 |
| 2012/0227961 | A1 | 9/2012 | Sehsah | |
| 2013/0133948 | A1 | 5/2013 | Lovorn | |
| 2014/0262506 | A1* | 9/2014 | Duman | E21B 21/001 175/5 |
| 2017/0002615 | A1* | 1/2017 | Girola | E21B 21/10 |
| 2018/0106118 | A1* | 4/2018 | Calderoni | E21B 21/08 |

* cited by examiner

COLLECTOR CIRCUIT FOR DRILLING FLUID CIRCULATION SYSTEM AND METHOD FOR DIVERTING THE CIRCULATION OF THE FLUID

This application is a National Stage Application of International Application No. PCT/IB2015/050223, filed 15 Jan. 2015, which claims benefit of Serial No. TO2014A000024, filed 16 Jan. 2014 in Italy and which applications are incorporated herein by reference. To the extent appropriate, a claim of priority is made to each of the above disclosed applications.

BACKGROUND OF THE INVENTION

The present invention relates to a collector circuit applicable to fluid circulation systems comprised in drilling rigs. A further aspect of the present invention relates to a process for continuous circulation of a fluid flow towards the bottom of a drilling well for a drilling rig, wherein said fluid flow, e.g. drilling mud, runs in a fluid circulation system comprising a collector circuit according to the present invention.

In particular, the present invention relates to the conformation of the collector circuit applicable to a circulation system, even an already existing one, for continuous circulation of drilling fluids during all of the operating sequences of a drilling rig. Furthermore, the present invention relates to the steps of the process for continuous circulation of a fluid flow in a circulation system according to the present invention during all of the operating sequences of a drilling rig.

The circulation system according to the present invention comprises at least one collector circuit allowing continuous circulation of fluids, such as, for example, drilling mud, during all of the operating steps of a drilling rig. Said collector circuit can at least intercept and divert at least a part of the fluid flow circulating in the fluid circulation system according to the present invention.

The collector circuit, the system and the associated process are aimed at improving the safety of drilling rigs, by automatizing operations that are normally carried out manually in traditional drilling rigs.

It is known to those skilled in the art that in a drilling rig fluids such as drilling mud need to circulate through a drill bit located at the bottom of the drilling well or in proximity thereto. Said drill bit is located at the end of a series of drilling elements, such as drill pipes. In particular, it is necessary that fluid circulation towards the drill bit also takes place during the steps of inserting or removing the drill pipes, in order to prevent damage to the open hole of the drilling well. In prior-art systems, pressure fluctuations at the bottom of the drilling well occur when turning on or off the drilling pump of the circulation system while inserting or removing pipes. Such pressure fluctuations may cause landslips and/or entry of fluids into the well.

This problem is particularly felt for critical wells, such as, for example, deep, deviated, horizontal and extended-reach wells.

For better performance and safety, in fact, the pressure at the bottom of the drilling well should be constantly kept at desired levels.

Collector devices for fluids such as drilling mud are known in the art as manifolds. The function of said collector devices is to intercept and divert a fluid flow, e.g. drilling mud coming from the drilling pumps, allowing both circulation via a main circuit leading to the top drive and lateral circulation via a secondary circuit. Lateral circulation normally occurs during the steps of adding or removing one or more drill pipes connected in series to define the drill length, as is known to those skilled in the art. Lateral circulation via said secondary circuit is normally activated by connecting a duct to a radial aperture provided on the drilling elements, such as connectors, subs or drill pipes.

Said radial aperture normally comprises safety valves. The connection between the radial aperture and the secondary circuit, which is fluid-dynamically connected to the collector circuit, can be established either manually or by means of automatic devices for opening such radial valves in a semiautomatic manner, during the steps of adding or removing drill pipes.

At least one portion of such collector devices cannot undergo maintenance when the device is inserted in the drilling mud circulation system and a fluid flow is running through it.

In addition, such collector devices do not ensure a high degree of operator safety, particularly in the portion of the collector circuit towards the secondary circuit. In the operating configuration for diverting the fluid flow towards the secondary circuit, in fact, such collector devices have just one valve for separating the fluid circulation circuit from the secondary circuit.

Furthermore, the collector devices currently available in the art are separate devices that cannot be interfaced to the drilling rig from a control viewpoint.

Prior-art collector devices do not allow performing a function for filtering the fluids flowing in the fluid circulation system.

It is known from US patent application 2004/178003 a drilling system for drilling a bore hole into a subterranean earth formation, wherein at least a portion of the mud flow from the primary mud pump is diverted to the mud discharge outlet, thereby creating a backpressure system to readily increase annular pressure.

US patent application 2013/133948 discloses a well drilling system which can include a hydraulics model which determines a modeled fluid friction pressure and a calibration factor applied to the modeled friction pressure, and a flow control device which is automatically controlled in response to a change in the calibration factor. A well drilling method can include drilling a wellbore, a fluid circulating through the wellbore during the drilling, determining a calibration factor which is applied to a modeled fluid friction pressure, and controlling the drilling based at least in part on a change in the calibration factor.

It is also known form US patent application 2007/227774 a method for controlling formation pressure during the drilling of a borehole through a subterranean formation includes selectively pumping a drilling fluid through a drill string extended into a borehole, out a drill bit at the bottom end of the drill string, and into an annular space between drill string and the borehole.

Patent application WO2011/050500 discloses a multi-level refined throttle manifold and an automatic control system. The multi-level refined throttle manifold system is composed of multiple plate valves and a throttle valve that are connected in parallel. The automatic control system enables micro-adjustment of wellhead return pressure under different pressure grades through starting and closing the different plate valves, and through adjusting the throttle valves continuously.

It is known from US 2012/227961 a method for determining annulus/wellbore fluid pressure, which is corrected for movement of a pipe string into or out of a wellbore, includes determining an initial annulus fluid pressure in the wellbore.

SUMMARY OF THE INVENTION

The present invention aims at solving such technical drawbacks by providing a collector circuit that does not suffer from the above-mentioned problems while ensuring a higher level of safety and allowing access to at least one portion of said collector circuit, e.g. for maintenance. The collector circuit according to the present invention allows access to at least one portion thereof, also when in operation, while allowing the collector circuit to be interfaced, from a control viewpoint, to other systems comprised in a drilling rig, for the purpose of automatizing the drilling rig and controlling it as automatically as possible.

One aspect of the present invention relates to a collector circuit.

A further aspect of the present invention relates to a fluid circulation system for continuous feeding of a fluid flow into a drilling well.

A further aspect of the present invention relates to a process for circulating a fluid flow towards the bottom of a drilling well.

BRIEF DESCRIPTION OF THE DRAWINGS

Auxiliary features are set out in the appended dependent claims.

The features and advantages of the collector circuit, of the fluid circulation system and of the process according to the present invention will become apparent in the light of the following description of one exemplary and non-limiting embodiment of the collector circuit, of the system and of the process, as well as from the annexed drawings, wherein:

FIG. 1A shows the system when fluid circulation towards the bottom of the drilling well occurs via a main circuit, and FIG. 1B shows the system when fluid circulation towards the bottom of the drilling well occurs via a secondary circuit;

FIG. 2A is a general view of the collector circuit; FIG. 2B shows the first sub-circuit of the collector circuit; FIG. 2C shows the second sub-circuit of the collector circuit;

FIG. 3A shows the system when the second sub-circuit is disconnected from the radial aperture on the drilling element positioned in the drilling well; FIG. 3B shows the fluid circulation system when the second sub-circuit is connected to the radial aperture on the drilling element positioned in the drilling well;

FIG. 5A shows the secondary circuit starting to pressurize; FIG. 5B shows the fluid circulation system when a continuous fluid flow has been definitively established in said secondary circuit towards the bottom of the drilling well;

DETAILED DESCRIPTION

Figure 1A:
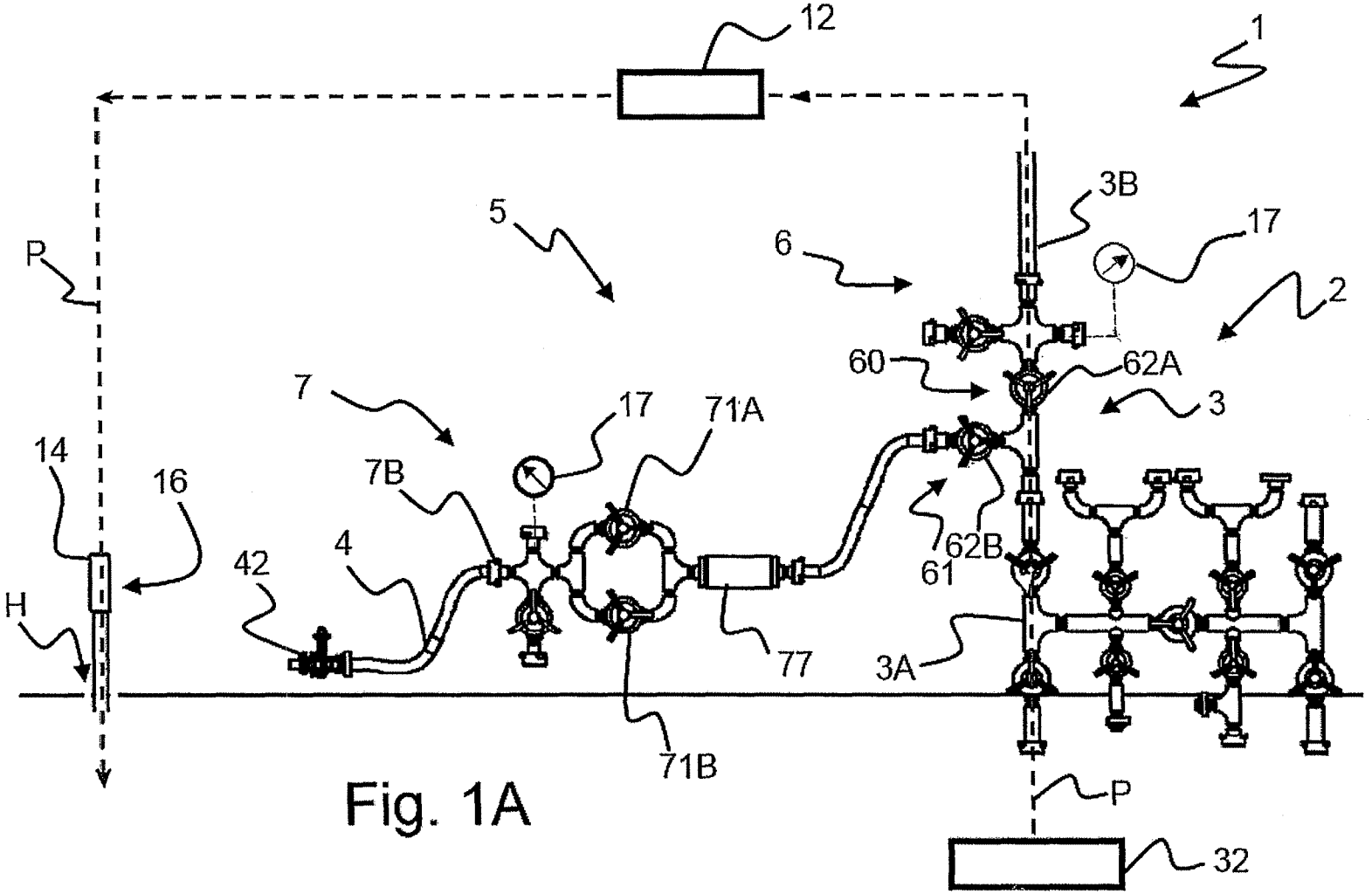
FIGS. 1A and 1B show a fluid circulation system and a collector circuit according to the present invention, applied to a drilling rig represented herein in stylized form, in particular.

With reference to the above-mentioned drawings, collector circuit 5 according to the present invention is for intercepting and selectively diverting, at least partially, a fluid flow "P", such as, for example, drilling mud. Said fluid flow "P" runs continuously in a fluid circulation system 2. Said fluid circulation system 2 is comprised in a drilling rig 1.

Said fluid circulation systems 2 are adapted to feed a fluid flow "P", e.g. drilling mud, into a drilling well "H", the latter being made by drilling rig 1 itself, as is known to those skilled in the art.

Collector circuit 5 according to the present invention comprises a first sub-circuit 6, which in turn comprises at least one first duct 60 comprising at least one first valve 62A.

The same first sub-circuit 6 comprises at least one second duct 61, which in turn comprises at least one second valve 62B.

Collector circuit 5 further comprises at least one second sub-circuit 7.

Said first sub-circuit 6, depending on the operating configuration of said at least one first valve 62A and said at least one second valve 62B, is adapted to either allow the transit of said fluid flow "P" in said at least one first duct 60 or selectively divert at least one portion of said fluid flow "P" towards said at least one second duct 61.

Said at least one second sub-circuit 7 is fluid-dynamically connected to said at least one second duct 61 of the first sub-circuit 6, preferably in a direct manner. Said at least one second sub-circuit 7 is adapted to receive at least one portion of fluid flow "P", diverted by said first sub-circuit 6, and direct it towards at least one first outlet 7B of the same second sub-circuit 7.

Said at least one second sub-circuit 7 and said first sub-circuit 6 are independent of each other. Said at least one second sub-circuit 7 is removable from collector circuit 5.

Said collector circuit 5 can be connected to a fluid circulation system 2 for continuously feeding a fluid flow "P" into a drilling well "H".

Figure 1B:
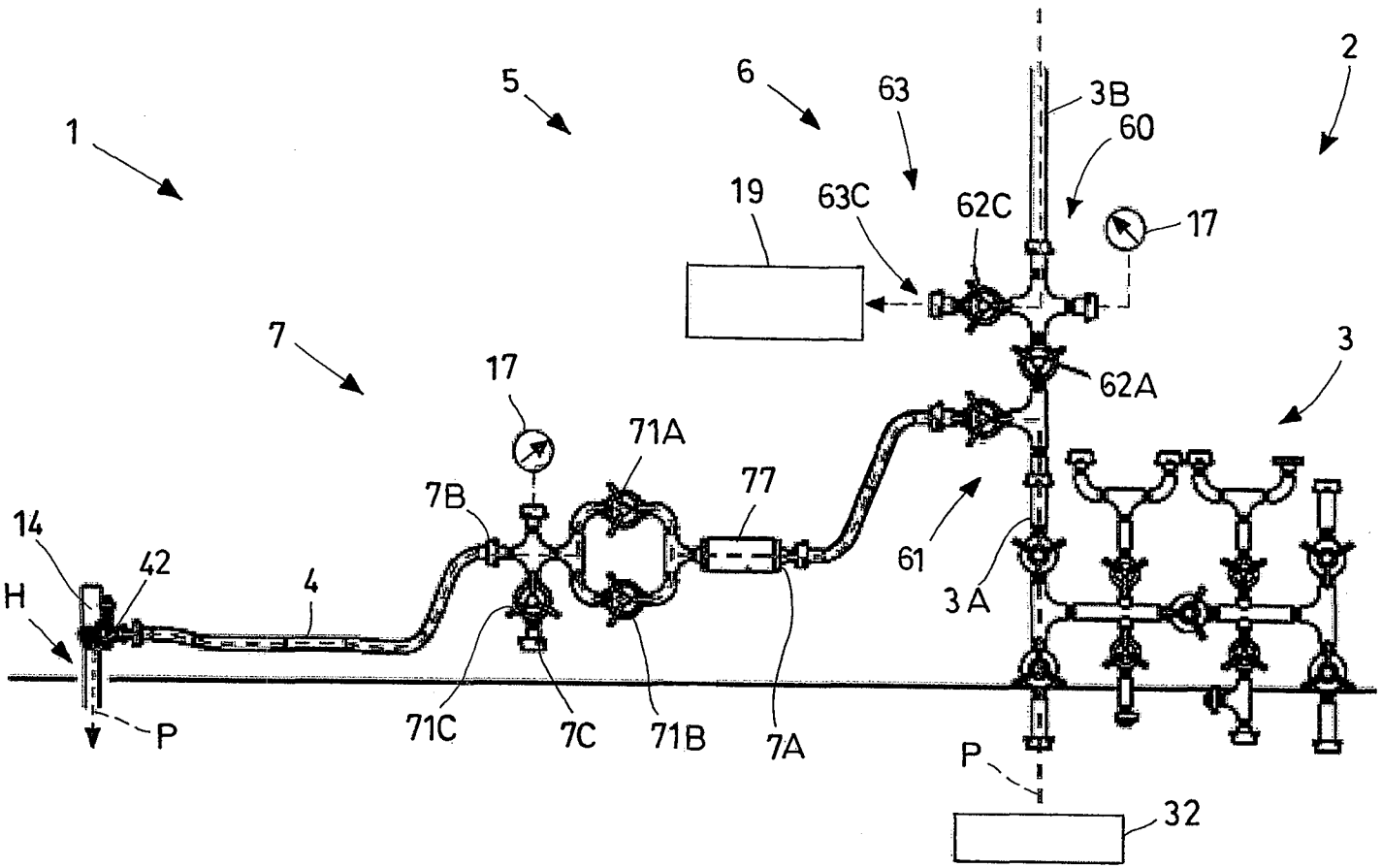

In general, as shown by way of example in FIGS. 1A and 1B, said circulation system 2 comprises a main circuit 3 in which said fluid flow "P" runs, comprising at least one main pump 32. Said main circuit 3 is adapted to be connected to a top drive 12 of drilling rig 1. The same fluid circulation system 2 comprises at least one secondary circuit 4 in which said fluid flow "P" may run. Said at least one secondary circuit 4 is adapted to be connected to a radial aperture 16 comprised in a drilling element 14 of drilling rig 1. Preferably, at least one safety valve is associated with said radial aperture 16, which valve is fixed to drilling element 14 positioned in drilling well "H", as is known to those skilled in the art. Drilling element 14 itself comprises an axial safety valve, as is known to those skilled in the art.

Said secondary circuit 4 is preferably created by means of a duct, and comprises a coupling device 42, which will not be described in detail herein. Said coupling device 42 is adapted to be inserted, whether automatically or semiautomatically, into radial aperture 16 of drilling element 14 positioned in drilling well "H". Said coupling device 42 is adapted to ensure mechanical fastening and pressure tightness. The fastening of coupling device 42 to radial aperture 16 allows fluid flow "P" to be supplied into the series of drilling elements 14 inserted in drilling well "H", towards the drill bit located at the bottom end of the same series of drilling elements 14, as is known to those skilled in the art. Said coupling device 42 is located at one end of a flexible duct comprised in said secondary circuit 4. Said coupling device 42 may be able to open and close an additional safety element, e.g. a plug located at the radial aperture.

Secondary circuit 4 is preferably created by means of a flexible duct, for the purpose of ensuring the utmost mobility of secondary circuit 4 for easy connection to and disconnection from radial aperture 16 of drilling element 14.

Fluid circulation system 2 comprises a collector circuit 5 according to the present invention, for intercepting and selectively diverting at least one portion of said fluid flow "P", e.g. drilling mud, circulating in said main circuit 3 towards said at least one secondary circuit 4. The intercepting and selective diverting actions carried out by collector circuit 5 ensure continuous circulation of fluid flow "P" towards the bottom of drilling well "H" during all of the operating sequences of a drilling rig. The sequence of configurations of collector circuit 5, of fluid circulation system 2 and of drilling rig 1 is sequentially shown in FIGS. 3A-10.

Said first duct 60 of the first sub-circuit 6 of collector circuit 5 can be connected to main circuit 3 of said fluid circulation system 2, as shown by way of example in FIGS. 1A, 1B and 3A-10.

Said at least one second sub-circuit 7 can be connected to a secondary circuit 4 comprised in the same fluid circulation system 2, as shown by way of example in FIGS. 1A, 1B, 2C and 3A-10. In particular, said at least one first outlet 7B can be connected, preferably in a direct manner, to said secondary circuit 4.

In general, the first sub-circuit 6 is that portion of collector circuit 5 which faces towards top drive 12 of drilling rig 1. The first sub-circuit 6 also performs the function of selectively diverting fluid flow "P", which normally runs in main circuit 3 towards top drive 12, towards the second sub-circuit 7 and hence towards the secondary circuit 4, and vice versa, as shown by way of example in FIGS. 2A and 2B.

Said first sub-circuit 6 can be connected to said main circuit 3 of fluid circulation system 2 in any position in line with the same main circuit 3. In particular, said first sub-circuit 6 is interposed between a first portion 3A and a second portion 3B of main circuit 3.

For the purposes of the present description, the phrase "connected in line with main circuit 3" means that said first sub-circuit 6 is located between two portions (3A, 3B) of the same main circuit 3, so that fluid flow "P" that runs in the same main circuit 3 can also run in the first sub-circuit 6. As shown by way of non-limiting example in the annexed drawings 1A, 1B and 3A-10, said first sub-circuit 6 is connected in line with a main circuit 3, which is divided into two portions (3A, 3B). By way of example, said first sub-circuit 6 is connected between a first portion 3A and a second portion 3B, wherein said first portion 3A is located upstream of the first sub-circuit 6 with respect to the direction of fluid flow "P", e.g. between at least one main pump 32 and the same first sub-circuit 6, and a second portion 3B, located downstream of the second sub-circuit 6, e.g. between the same first sub-circuit 6 and top drive 12.

In general, the connection of collector circuit 5, particularly of the first sub-circuit 6, to main circuit 3 of system 2 can be implemented by using flexible or rigid tubing.

The first sub-circuit 6 can be considered as an extension of the traditional manifold installed on the drill floor of drilling rig 1. Apart from the drill floor of drilling rig 1, the first sub-circuit 6 may also be installed at ground level, e.g. directly integrated into circulation system 2.

Said at least one second sub-circuit 7 can be connected to the first sub-circuit 6 by means of a duct, e.g. a flexible duct. Such a solution allows arranging said at least one second sub-circuit 7 in a plane which is different from the one in which the first sub-circuit 6 lies, e.g. at different heights from the ground.

Also said at least one second sub-circuit 7 can be positioned at drill floor level or at ground level.

Said at least one second sub-circuit 7, just like the whole collector circuit 5, is independent of fluid circulation system 2, particularly of main circuit 3.

Said at least one second sub-circuit 7 is separable from fluid circulation system 2, so that, during the drilling operations of drilling rig 1, at least one second sub-circuit 7 can be excluded from the circulation of fluid flow "P".

Said at least one second sub-circuit 7 is that portion of the collector circuit 5 which faces towards secondary circuit 4, as shown by way of example in FIGS. 1A, 1B, 2A, 2C, in particular towards radial aperture 16 associated with a drilling element 14.

Figure 3A:
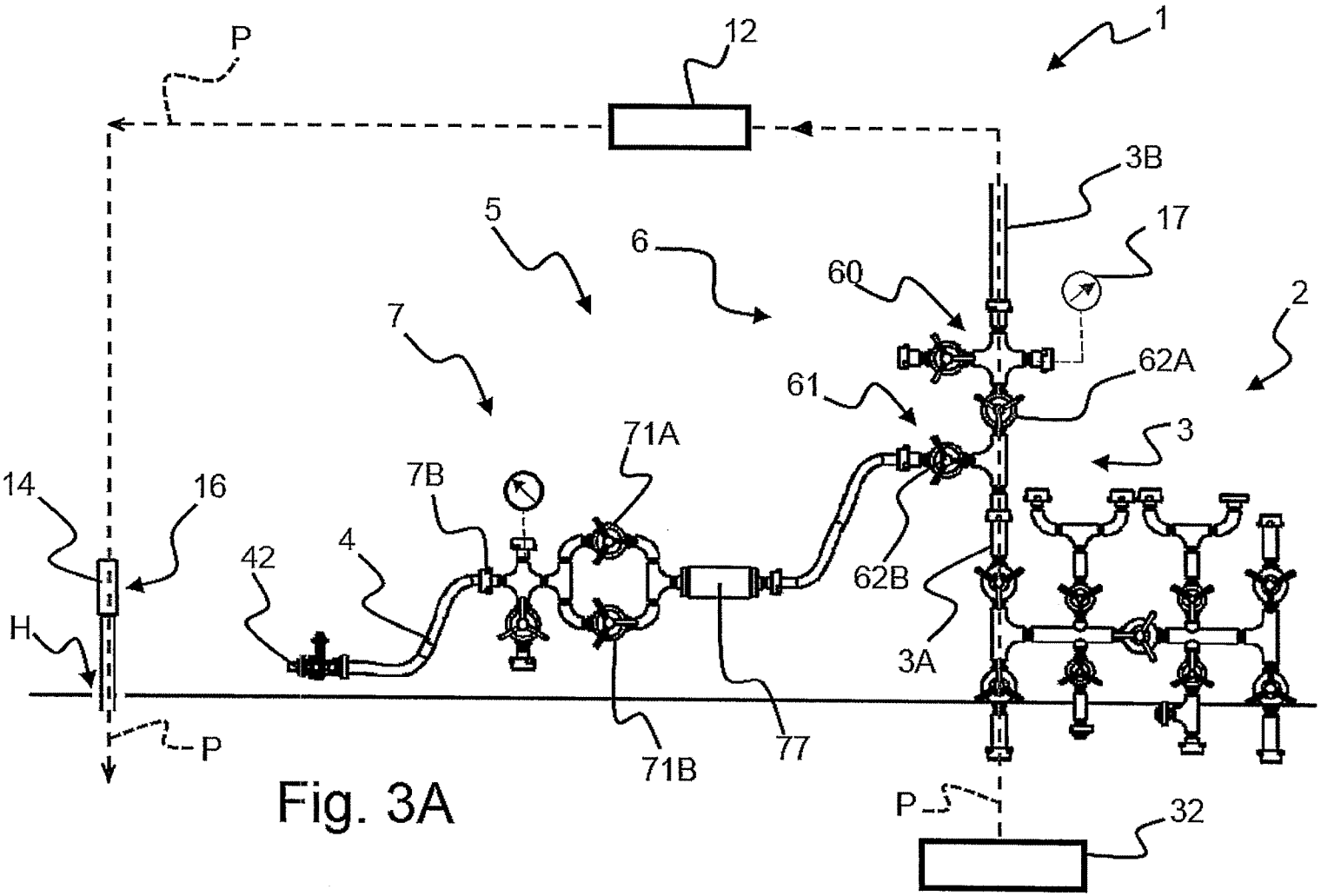
FIGS. 3A and 3B show the drilling rig when the fluid circulation system and the collector circuit are in an initial configuration that allows the fluid to flow solely in the main circuit of the circulation system; in particular.
Figure 10:
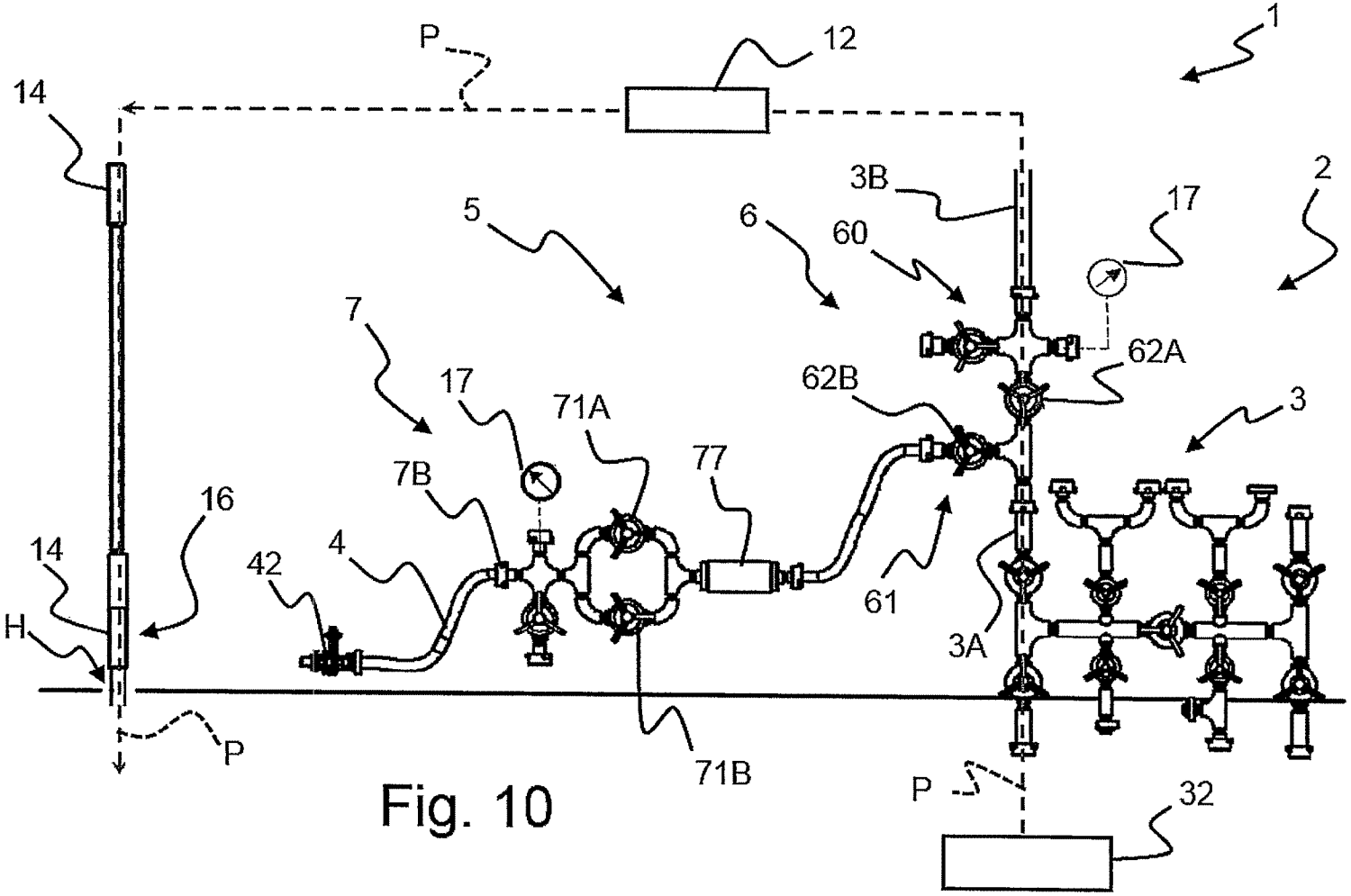
FIG. 10 shows the circulation rig when the fluid circulation system has returned into the initial configuration of FIG. 3A or 3B, wherein it allows the fluid to flow solely in the main circuit, in particular wherein the secondary circuit is disconnected from the radial aperture on a drilling element positioned in the drilling well.

Said at least one second sub-circuit 7 is always bypassed during the drilling operations of a drilling rig 1, as shown by way of example in FIGS. 1A, 3A and 10. In particular, said at least one second sub-circuit 7 is activated, through said first sub-circuit 6, by feeding it with at least a part of fluid flow "P", only during the steps of adding/removing a plurality of drilling elements 14, e.g. drill pipes, having the desired drill length. In particular, said second sub-circuit 7 is activated when it is necessary to have fluid flow "P" run through secondary circuit 4 instead of main circuit 3, as shown by way of example in FIGS. 4-8.

Describing more in detail the implementation of collector circuit 5 according to the present invention, said first sub-circuit 6 comprises at least one inlet 60A and at least one first outlet 60B, which are connected to each other by said first duct 60; and at least one second outlet 61B comprised in said second duct 61, into which at least one portion of fluid flow "P" is diverted.

Said at least one inlet 60A is adapted to receive fluid flow "P" coming from circulation circuit 2, particularly from main circuit 3, more particularly from the first portion 3A.

Said first outlet 60B is connected to the second portion 3B of main circuit 3 that faces towards top drive 12.

Said at least one second outlet 61B is the terminal portion of said at least one second duct 61 of the first sub-circuit 6. Each second outlet 61B is connected to the respective second sub-circuit 7, and faces towards the corresponding secondary circuit 4.

Describing more in detail the implementation of collector circuit 5, said at least one second sub-circuit 7 comprises an inlet 7A, through which fluid flow "P", diverted by said first sub-circuit 6, enters. Said inlet 7A is connected to the second outlet 61B of the second duct 61 of the first sub-circuit 6.

In general, said at least one second sub-circuit 7 comprises at least one valve (71A, 71B) for regulating said at least one portion of fluid flow "P" directed towards said at least one first outlet 7B. Said first outlet 7B is connected to a secondary circuit 4 of fluid circulation system 2.

Said at least one valve (71A, 71B) is adapted to control said at least one portion of fluid flow "P", e.g. drilling mud, diverted by said first sub-circuit 6. The control provided by said at least one valve (71A, 71B) is adapted to allow continuous circulation of the fluid flow towards the bottom of a drilling well "H".

In one exemplary embodiment, said at least one second sub-circuit 7 comprises a first valve 71A and a second valve 71B, arranged in parallel to each other. Said first valve 71A and said second valve 71B are both adapted to regulate said at least one portion of fluid flow "P" directed towards said at least one first outlet 7B. By way of example, said first valve 71A and said second valve 71B can control fluid flow "P" directed towards said at least one first outlet 7B, by adjusting the flow and rate thereof.

In general, said first sub-circuit 6 of collector circuit 5 according to the present invention comprises at least one first depressurization circuit 63.

Said first depressurization circuit 63 allows the first duct 60 of the first sub-circuit 6 to be depressurized or pressurized.

Said second sub-circuit 7 of collector circuit 5 according to the present invention comprises at least one second depressurization circuit 73.

Said second depressurization circuit 73 allows the second sub-circuit 7, in particular the first outlet 7B, to be depressurized or pressurized.

Preferably, said first depressurization circuit 63 is independent of said second depressurization circuit 73. Said depressurization circuits (63, 73) are distinct and independently controllable.

Said first depressurization circuit 63 can be fluid-dynamically connected to a fluid recovery circuit 19 comprised in drilling rig 1.

Said fluid recovery circuit 19 is adapted to recover the fluids used during the drilling operations of drilling rig 1 for reuse in a continuous cycle. Said fluid recovery circuit 19 can be fluid-dynamically connected to fluid circulation system 2, as is known to those skilled in the art.

Said second depressurization circuit 73 can be fluid-dynamically connected to a fluid recovery circuit 19.

Preferably, drilling rig 1 internally comprises a single fluid recovery circuit 19, which is fluid-dynamically connected to both the first depressurization circuit 63 and the second depressurization circuit 73.

Describing again more in detail the implementation of collector circuit 5, said at least one first depressurization circuit 63 of the first sub-circuit 6 comprises at least one third outlet 63C, which can be connected to the fluid recovery circuit 19, and at least one third valve 62C for regulating a second fluid flow "W" directed towards said at least one third outlet 63C.

Said third valve 62C allows the second portion 3C of main circuit 3 to be depressurized or pressurized, for better circulation transitions from main circuit 3 to the secondary circuit 4, and vice versa.

Said at least one second depressurization circuit 73 comprises a second outlet 7C that can be connected to fluid recovery circuit 19; and at least one third valve 71C for regulating a second fluid flow "W" directed towards said at least one second outlet 7C.

Said third valve 71C allows depressurizing or pressurizing the second sub-circuit 7 and hence the whole secondary circuit 4, thereby allowing maintenance of collector circuit 5, in particular of the second sub-circuit 7. Said third valve 71C makes for better transitions in the circulation of fluids "P" towards the bottom of drilling well "H" between secondary circuit 4 and main circuit 3 of fluid circulation system 2.

At least one pressure measuring device 17, e.g. a pressure gauge, is connected to at least one outlet (60B, 63C) of the first sub-circuit 6. Preferably, said first sub-circuit 6 comprises a pressure gauge 17 that allows measuring the pressure in proximity to said first outlet 60B.

At least one pressure measuring device 17, e.g. a pressure gauge, is connected to at least one outlet (7B, 7C) of the second sub-circuit 7. Preferably, said second sub-circuit 7 comprises a pressure gauge 17 that allows measuring the pressure in proximity to said first outlet 7B.

Figure 2A:
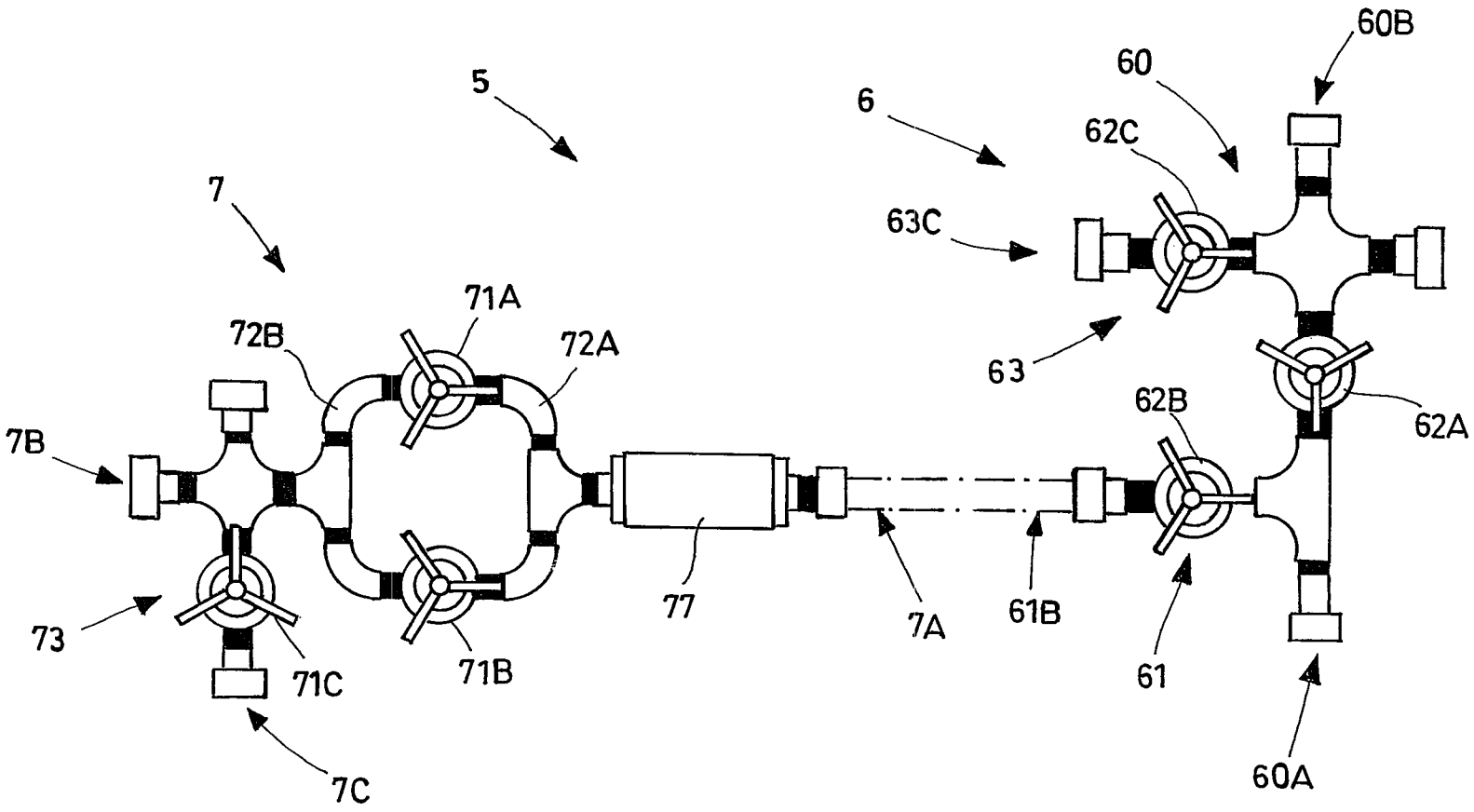
FIGS. 2A, 2B and 2C show the collector circuit according to the present invention; in particular.
Figure 2B:
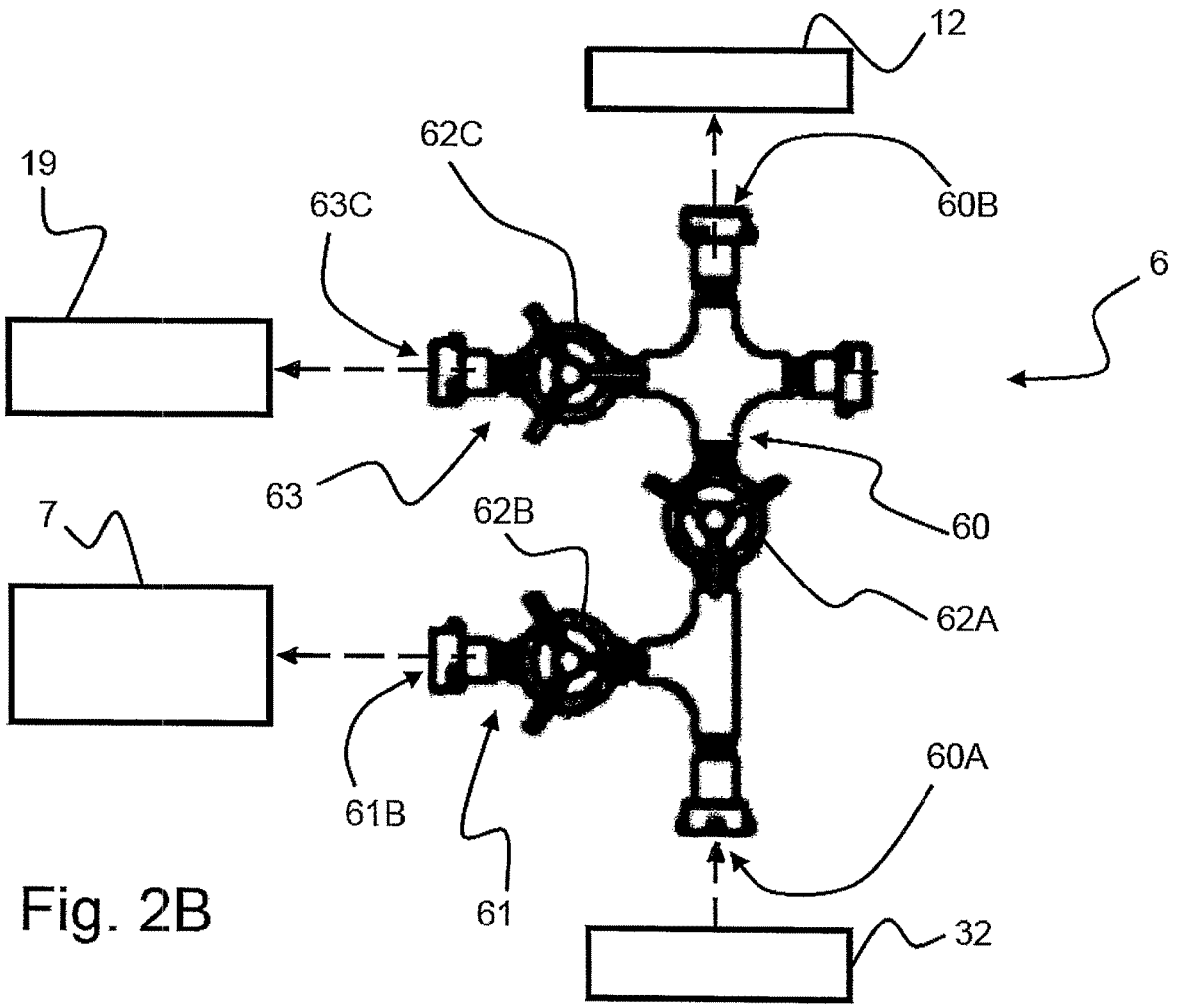
Figure 2C:
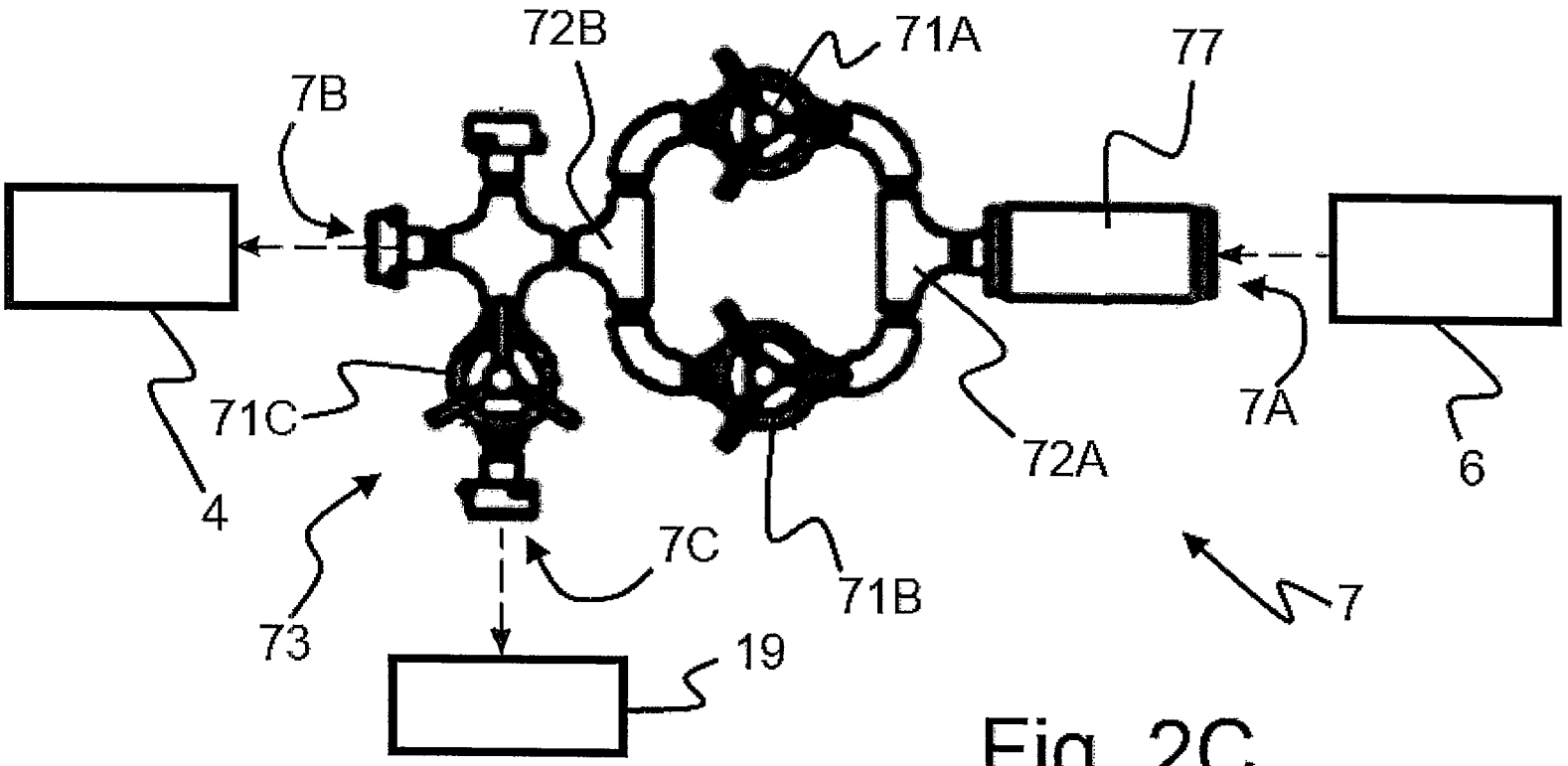

Said at least one second sub-circuit 7 comprises at least one filtering device 77 for filtering the fluid flowing in said second sub-circuit 7, as shown by way of example in FIGS. 2A and 2C. Said filtering device 77 improves the efficiency of said sub-circuit 7, with clear functional and safety advantages, as can be easily understood by a man skilled in the art.

Said filtering device 77 is arranged in line with said first sub-circuit 7, e.g. in proximity to said inlet 7A.

During intake and/or delivery of fluid flow "P" diverted towards said second sub-circuit 7, filtering device 77 is adapted to filter said fluid flow "P" running in said second sub-circuit 7. Said filtering device 77 is characterized by better filtering properties than the filters commonly installed at the intake port of main pumps 32 included in fluid circulation circuit 2. Said filtering device 77 is removable from the second sub-circuit 7 during those steps that do not require the fluid to flow through sub-circuit 7, with clear advantages in terms of efficiency and drilling performance, so that it can be replaced as necessary.

In general, at least one of the valves comprised in collector circuit 5 according to the present invention is automatic or semiautomatic. Preferably, all the valves comprised in collector circuit 5 are semiautomatic ones; more preferably, they are all automatic ones. The actuating devices for opening and/or closing the valves comprised in collector circuit 5 are controlled by a control unit, which will not be illustrated in detail herein. Said control unit may be placed on the drill floor or be included in the control system of the whole drilling rig 1. Said actuating devices may, for example, be controllable by the operator in the dog house.

Said fluid recovery circuit 19 and depressurization circuits (63, 73) of collector circuit 5 are also controlled by means of automatic valves, preferably remotely actuated from, for example, the dog house.

Said coupling device 42 may be controlled by the same control unit that controls the opening and closing of the valves comprised in collector circuit 5 according to the present invention.

In a preferred but non-limiting embodiment of collector circuit 5, as shown by way of example in FIG. 2A, said first sub-circuit 6 comprises only one first duct 60 in which said first fluid flow "P" runs when said first sub-circuit 6 is directing the fluid flow towards said main circuit 3, in particular towards the second portion 3B. A single first valve 62A is comprised along said first duct 60. The same first sub-circuit 6 comprises only one second duct 61, into which at least one portion of fluid flow "P" is diverted when said first sub-circuit 6 is directing the fluid flow towards said second sub-circuit 7, which in turn directs it towards said secondary circuit 4. A single second valve 62B is comprised along said second duct 61.

Preferably, said first sub-circuit 6 comprises only one depressurization circuit 63. Said first depressurization circuit 63 is arranged, with reference to the direction of fluid flow "P" towards top drive 12, between the first valve 62A and the first outlet 60B, as shown by way of example in FIG. 2B.

FIG. 2B illustrates an exemplary embodiment of said first sub-circuit 6, wherein all components shown are clearly distinguishable by a man skilled in the art and should be considered as implicitly included in the present description, even though they will not be explicitly described.

Preferably, collector circuit 5 according to the present invention comprises only one second sub-circuit 7 fluid-dynamically connected, more preferably in a direct manner, to the second duct 61 of the first sub-circuit 6.

The second sub-circuit 7 comprises only one first outlet 7B to be connected to only one secondary circuit 4 of fluid circulation system 2.

Said second sub-circuit 7 comprises only one second depressurization circuit 73.

Said second sub-circuit 7 comprises only one filtering device 77 arranged in proximity to inlet 7A.

Said first valve 71A and said second valve 71B are fluid-dynamically arranged in parallel to each other. More in detail, said second sub-circuit 7 comprises a first fitting 72A that branches off into at least two ducts, one comprising said first valve 71A and another one comprising said second valve 71B. Downstream of said two valves (71A 71B), with reference to the direction of fluid flow "P", the two ducts are joined by a second fitting 72B. One example of such an arrangement is visible in FIG. 2C.

With reference to the direction of fluid flow "P", said second depressurization circuit 73 is arranged between the first valve 71A, or the second valve 71B, and the first outlet 7B.

FIG. 2*c* illustrates an exemplary embodiment of said second sub-circuit 7, wherein all components shown are clearly distinguishable by a man skilled in the art and should be considered as implicitly included in the present description, even though they will not be explicitly described.

The first sub-circuit 6 is adapted to take different operating configurations; in particular, said first valve 62A and said second valve 62B, depending on their operating configurations, allow the first sub-circuit 6 to take different operating configurations.

By way of example, in a first operating configuration of the first sub-circuit 6 said first valve 62A and said second valve 62B allow the transit of said fluid flow "P" in the first duct 60, in particular in said first duct 60 only, particularly towards the second portion 3B of main duct 3. In this operating configuration fluid flow "P" towards the second duct 61, and hence towards the second sub-circuit 7 and towards the secondary circuit 4, is interrupted.

Furthermore, in at least a second operating configuration of the first sub-circuit 6, said first valve 62A and said second valve 62B divert at least one portion of fluid flow "P" towards the second duct 61, and hence towards the second sub-circuit 7.

More in particular, in a third operating configuration of the first sub-circuit 6 said at least one first valve 62A and said at least one second valve 62B divert the whole fluid flow "P" towards the second duct 61, and hence towards the second sub-circuit 7. In the third operating configuration, fluid flow "P" towards the first duct 60, and hence towards the portion of main circuit 3, in particular the second portion 3B, is interrupted. In the third operating configuration, main circuit 3, in particular towards top drive 12, is excluded from the circulation of fluid flow "P".

In one exemplary embodiment, said at least one second sub-circuit 7 is independent of said first sub-circuit 6 and can be separated and/or excluded from collector circuit 5, in particular from said first sub-circuit 6, e.g. when the same first sub-circuit 6 is in a first operating configuration.

The second sub-circuit 7 is adapted to take different operating configurations; in particular, said first valve 71A and said second valve 71B, depending on their operating configurations, allow the second sub-circuit 7 to take different operating configurations.

By way of example, in a first operating configuration of the second sub-circuit 7 said first valve 71A and said second valve 71B prevent the transit of fluid flow "P" towards the first outlet 7B, and hence towards the secondary circuit 4.

In at least a second operating configuration of the second sub-circuit 7, said first valve 71A and/or said second valve 71B allow the pressurization of the second sub-circuit 7, and hence of the secondary circuit 4.

In a third operating configuration of the second sub-circuit 7, said first valve 71A and said second valve 71B allow fluid flow "P" to run under pressure in the second sub-circuit 7, and hence towards said secondary circuit 4.

In general, the diversion of fluid flow "P" circulating in fluid circulation system 2 is brought about by collector circuit 5, in particular by the first sub-circuit 6, through the controls that regulate the actuation of said at least three valves (62A-62C); in particular:

- the first valve 62A, which can be opened/closed to feed/bypass a first duct 60, in particular the main circuit 3, more in particular the second portion 3B, as concerns the circulation of fluid flow "P" towards a top drive 12;
- the second valve 62B, which can be opened/closed to feed/bypass the second sub-system 7;
- the third valve 62C, which can be opened/closed to depressurize or pressurize the first duct 60, and hence main circuit 3, in particular the second portion 3B.

Pressurization/depressurization of the first sub-circuit 6 provides pressurization/depressurization of main circuit 3, for better circulation transitions from the main circuit 3 to the secondary circuit 4, and vice versa.

Control of the fluid flow diverted by said first sub-circuit 6 towards the secondary circuit 4 is provided by the second sub-circuit 7 through the controls that regulate the actuation of said at least three valves (71A-71C); in particular:

- the first valve 71A, which can be opened/closed to pressurize and/or feed said second sub-circuit 4;

the second valve 71B, which can be opened/closed to pressurize and/or feed said second sub-circuit 4;

the third valve 71C, which can be opened/closed to depressurize or allow pressurization of the second sub-circuit 7.

Pressurization/depressurization of the second sub-circuit 7 provides pressurization/depressurization of secondary circuit 4, for better circulation transitions from main circuit 3 to secondary circuit 4, and vice versa.

The pressurization operation is only carried out if said secondary circuit 4 has established a pressure-tight connection with said radial aperture 14 through said coupling device 42.

As aforementioned, continuous fluid circulation system 2 for a drilling rig 1 is adapted to allow a first fluid flow "P" to run towards the bottom of a drilling well "H".

As aforementioned, said secondary circuit 4 is connected to radial aperture 16 during the operating steps of adding and removing drilling elements 14, when it is necessary to cause fluid flow "P" to run towards the bottom of drilling well "H" via said secondary circuit 4, in particular when it is not possible to convey the fluid flow towards the bottom of drilling well "H" via main circuit 3.

The process for continuous circulation of a fluid flow "P" towards the bottom of a drilling well "H" for a drilling rig 1 will be described below in its essential steps with reference to all of the operating steps of the rig itself.

The process comprises the following steps:

a) intercepting the pressurized fluid flow "P" that is running in a main circuit 3 of fluid circulation system 2;

b) diverting pressurized fluid flow "P", at least partially, towards at least one secondary circuit 4 of fluid circulation system 2;

c) interrupting the circulation of fluid flow "P" towards said main circuit 3;

d) depressurizing said main circuit 3;

e) maintaining the circulation of fluid flow "P" in secondary circuit 4 for a desired time;

f) restoring, at least partially, the circulation of pressurized fluid flow "P" towards main circuit 3;

g) interrupting the circulation of fluid flow "P" towards said secondary circuit 4;

h) depressurizing said secondary circuit 4;

i) maintaining the circulation of fluid flow "P" in main circuit 3 for the desired time.

The above-described process is implemented by using a collector circuit 5 according to the present invention.

In particular, step a) of intercepting the fluid flow comprises a first step of opening said second valve 62B of the first sub-circuit 6, while keeping said at least one valve (71A, 71B) of the second sub-circuit 7 closed. This step corresponds to setting said first sub-circuit 6 into a second operating configuration and setting the second sub-circuit 7 into the first operating configuration.

Step b) of diverting at least partially fluid flow "P" comprises a first operating step of opening at least one valve (71A, 71B) of the second sub-circuit 7, thereby allowing secondary circuit 4 to be pressurized. The first step corresponds to setting said first sub-circuit 6 into a second operating configuration and setting the second sub-circuit 7 into the second operating configuration. The same step b) comprises a second operating step of opening both valves (71A, 71B) of the second sub-circuit 7, thereby allowing fluid flow "P" to run under pressure into said secondary circuit 4. Said second step corresponds to setting said first sub-circuit 6 into a second operating configuration and setting the second sub-circuit 7 into the third operating configuration.

Step b) is only carried out if said secondary circuit 4 has established a pressure-tight connection with radial aperture 16 of a drilling element 14.

In this step, the safety valve at aperture 16 will open if the pressure in said secondary circuit 4 exceeds by a certain threshold the internal pressure of drilling element 14, as is known to those skilled in the art.

Step c) of interrupting the circulation towards said main circuit 3 comprises an operating step of closing said first valve 62A of the first sub-circuit 6 while keeping said second valve 62B of the same first sub-circuit 6 open, thereby allowing fluid flow "P" to run under pressure in said secondary circuit 4 only. This step corresponds to setting said first sub-circuit 6 into the third operating configuration and setting the second sub-circuit 7 into the third operating configuration.

Step d) of depressurizing main circuit 3 comprises an operating step of activating said first depressurization circuit 63 of the first sub-circuit 6. This step corresponds to opening said third valve 62C of the first depressurization circuit 63 while keeping the first sub-circuit 6 in the third operating configuration and said second sub-circuit 7 in the third operating configuration.

Step f) of restoring the fluid flow in main circuit 3 comprises an operating step of opening said first valve 61B while keeping both valves (71A, 71B) of the second sub-circuit 7 open. This step corresponds to setting said first sub-circuit 6 into a second operating configuration and setting the second sub-circuit 7 into the third operating configuration, while closing again the third valve 62C of the first depressurization circuit 63.

Step g) of interrupting the circulation in the secondary circuit 4 comprises an operating step of closing said second valve 62B of the first sub-circuit 6, thereby allowing fluid flow "P" to run under pressure in said main circuit 3 only. This step corresponds to setting said first sub-circuit 6 into the first operating configuration while keeping the second sub-circuit 7 in the third operating configuration.

Step h) of depressurizing secondary circuit 4 comprises an operating step of activating said second depressurization circuit 73 of the second sub-circuit 7. This step corresponds to opening said third valve 71C of the second depressurization circuit 73 while keeping the first sub-circuit 6 in the first operating configuration and the second sub-circuit 7 in the third operating configuration.

Step i) allows closing the safety valve at radial aperture 16, allowing circulation of fluid flow "P" to occur via said main circuit 3, as is known to those skilled in the art.

After step i), the connection of secondary circuit 4 can be removed from radial aperture 16 of drilling element 14. It is also possible to set the second sub-circuit into the first operating configuration.

A summary table is shown below by way of non-limiting example, which indicates the state of the different valves of collector circuit 5, in particular of the different sub-circuits (6, 7), with reference to the operating steps of a drilling rig 1 with which fluid circulation system 2 is associated.

| Operating steps of drilling rig 1 | State of valves of first sub-circuit 6 (open/closed) | | | State of valves of second sub-circuit 7 (open/closed) | | |
|---|---|---|---|---|---|---|
| | First valve 62A | Second valve 62B | Third valve 62C | First valve 71A | Second valve 71B | Third valve 71C |
| Drilling step | Open | Closed | Closed | Closed | Closed | Closed |
| Connecting coupling device 42 to radial aperture 16 | Open | Closed | Closed | Closed | Closed | Closed |
| Feeding second sub-circuit 7 | Open | Open | Closed | Closed | Closed | Closed |
| Pressurization of secondary circuit 4 | Open | Open | Closed | Open | Closed | Closed |
| Starting lateral circulation via secondary circuit 4 | Open | Open | Closed | Open | Open | Closed |
| Closing and draining main circuit 3 | Closed | Open | Open | Open | Open | Closed |
| Adding new series of drilling elements 14 | Closed | Open | Closed | Open | Open | Closed |
| Opening main circuit 3 again | Open | Open | Closed | Open | Open | Closed |
| Closing and draining secondary circuit 4 | Open | Closed | Closed | Open | Open | Open |
| Removing and decoupling coupling device 42 | Open | Closed | Closed | Closed | Closed | Closed |

The following will describe in more detail, by way of non-limiting example, the different configurations of the valves of collector circuit 5 during the various operating steps of drilling rig 1 as listed in the table.

During the drilling step, fluid flow "P" circulates within the set of drilling elements 14, e.g. drill pipes, via main circuit 3 of fluid circulation system 2. Said fluid flow "P" runs through top drive 12. In this step, the first valve 62A of the first sub-circuit 6 of collector circuit 5 is the only valve in the open configuration. The second valve 62B of the first sub-circuit 6 is closed, and the second sub-circuit 7 is excluded from the circulation of fluid flow "P". In this operating configuration, the second sub-circuit 7 can be removed from collector circuit 5, e.g. for maintenance activities.

Such an operating configuration of the valves of collector circuit 5 causes the pressure in main circuit 3, downstream of the first sub-circuit 6, to be equal to the working pressure, e.g. generated by main pump 32. Instead, in secondary circuit 4 there is ambient pressure, as shown by way of example in FIG. 3A.

For the purposes of the present description, in FIGS. 3A-10 pressure measuring devices 17 are represented by an arrow pointing to the left, if in that section of the circuit there is a pressure substantially equal to the ambient pressure; on the contrary, pressure measuring devices 17 are represented by an arrow pointing to the right, if in that section of the circuit there is a pressure substantially equal to the working pressure.

Once the drilling step has been completed, it is necessary to add a plurality of drill pipes having a desired drill length, as is known to those skilled in the art. In prior-art drilling rigs, in this step there is normally an interruption of the circulation of fluid flow "P" towards the bottom of drilling well "H".

Figure 3B:
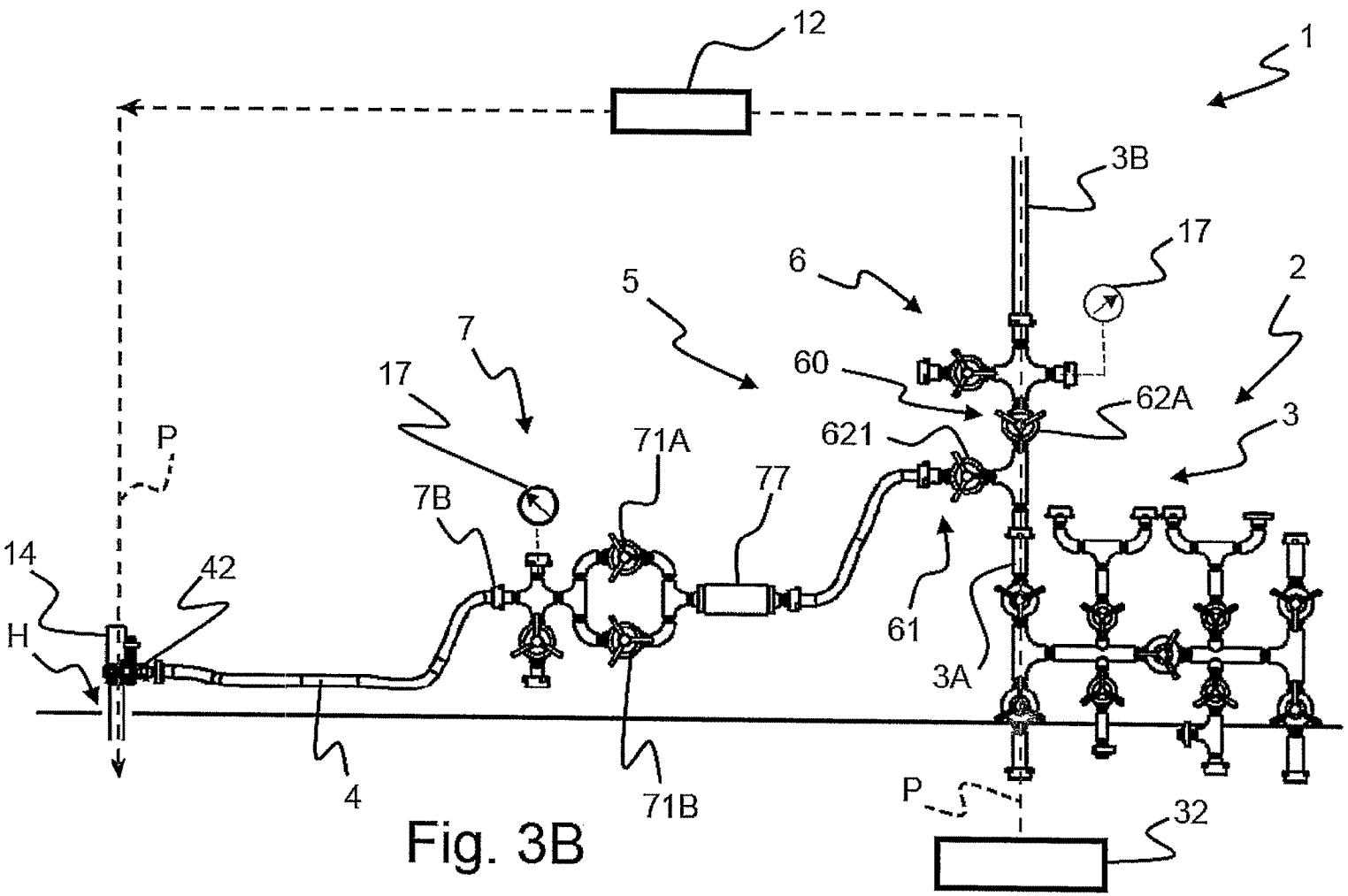

While keeping unchanged the operating conditions of the drilling step, in particular with the fluid circulating via main circuit 3, in the rig according to the present invention the next step envisages the connection of coupling device 42 to radial aperture 16, as shown by way of example in FIG. 3B. This operation can take place automatically or semiautomatically.

During this step, radial aperture 16 is put into communication with fluid circulation circuit 2 through said secondary circuit 4.

The pressure and rate of fluid flow "P" in main circuit 3 remain unchanged and equal to the working conditions of the drilling step; while secondary circuit 4 and the second sub-circuit 7 are still excluded from the circulation of the fluid flow and the pressure therein is still equal to the ambient pressure.

Once mechanical fastening and pressure tightness have been ensured between coupling device 42 and radial aperture 16, the next step of feeding the second sub-circuit 7 can be carried out. In this step of feeding the second sub-circuit 7, second valve 62B of the first sub-circuit 6 is opened.

Figure 4:
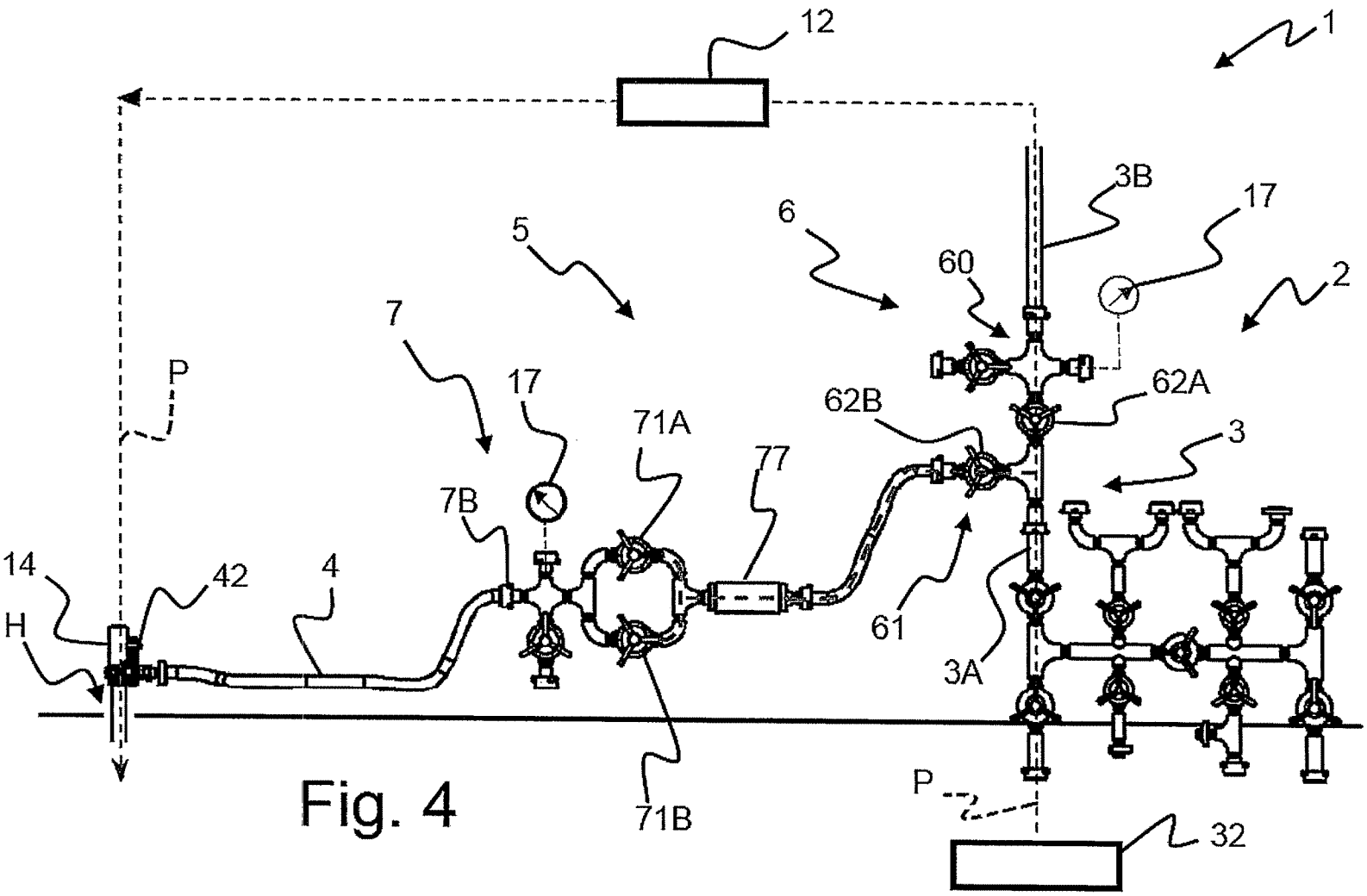
FIG. 4 shows the drilling rig when the fluid circulation system and the collector circuit are in an operating configuration wherein the collector circuit intercepts, at least partially, the fluid flow, which continues to run in the main circuit of the circulation system.

When the second valve 62B of the first sub-circuit 6 opens, the second sub-circuit 7 is put into communication with the same first sub-circuit 6, as shown by way of example in FIG. 4. A volume of fluid "P", which is negligible compared to the total circulating flow, is tapped from main circuit 3 to feed the second sub-circuit 7.

In this step, both the first valve 71A and the second valve 71B of the second sub-circuit 7 are still closed, so that the pressure and rate of fluid flow "P" in main circuit 3 remain substantially unchanged and equal to the working conditions of the drilling step. Although in a first section of the second sub-circuit 7 there is already a part of fluid flow "P", the secondary circuit 4 is still excluded from the circulation of fluid flow "P" and is at a pressure equal to the ambient pressure.

It is then possible to continue with the step of pressurizing the second sub-circuit 7.

Figure 5A:
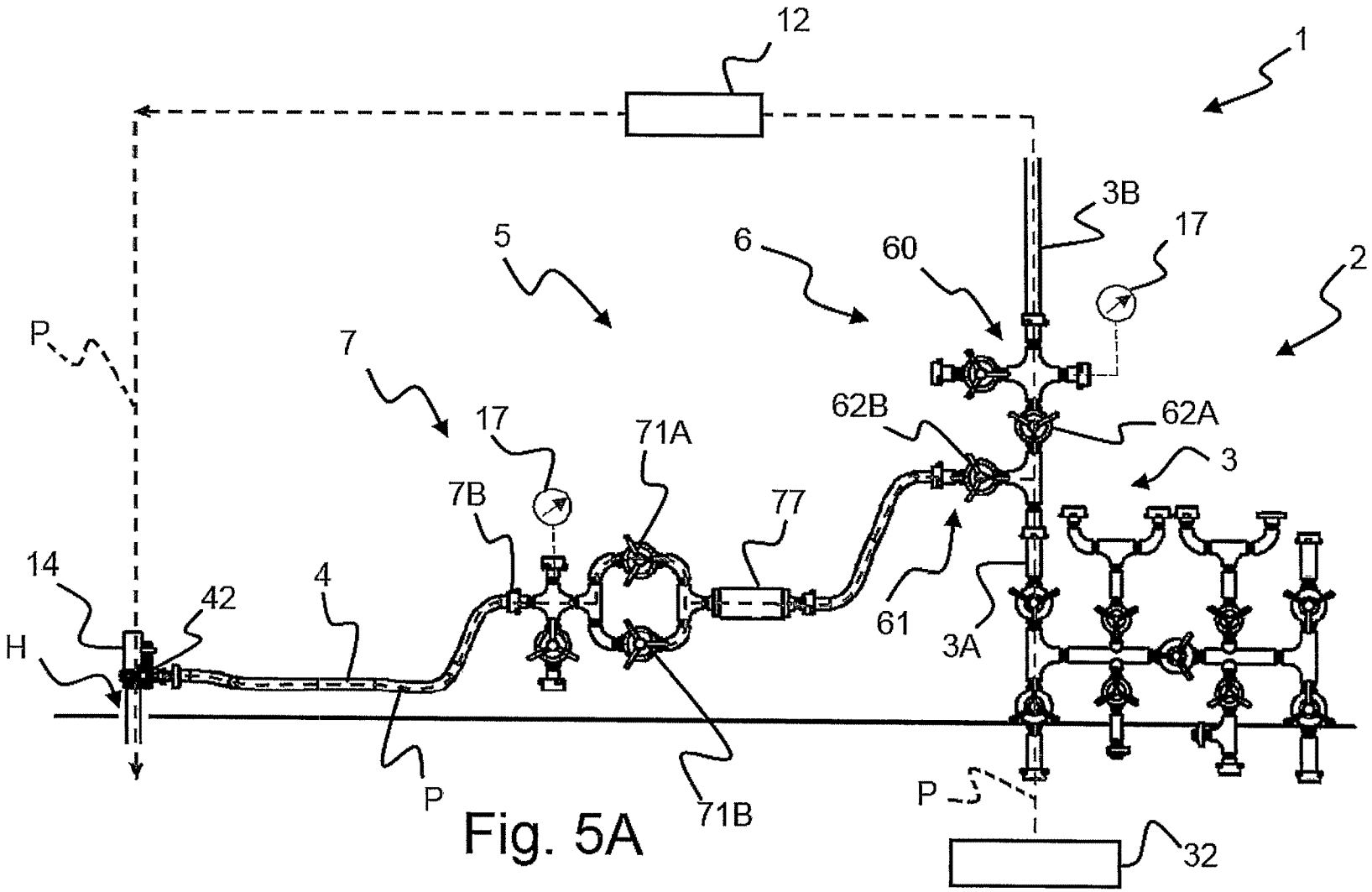
FIGS. 5A and 5B show the drilling rig when the fluid circulation system and the collector circuit are in an operating configuration wherein the fluid flow is at least partially diverted by the collector circuit towards the secondary circuit of the circulation system; in particular.
Figure 5B:
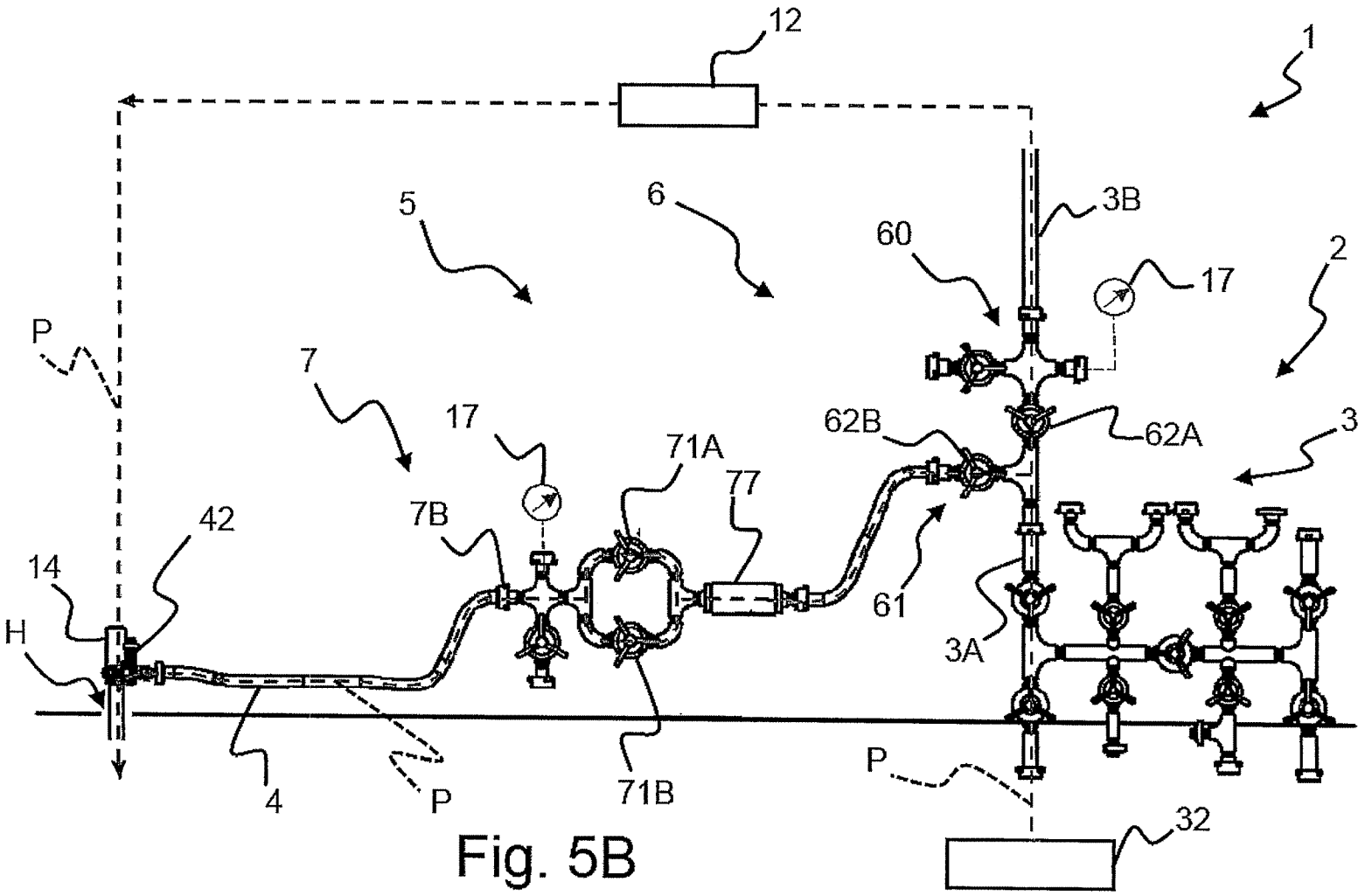

In this step, the first valve 71A, or possibly the second valve 71B, of the second sub-circuit 7 is opened, thereby starting the circulation of at least one portion of fluid flow "P" via said secondary circuit 4, as shown by way of example in FIG. 5A.

The opening of the first valve 71A allows the pressure in secondary circuit 4 to gradually increase, until it reaches the working value. Both fluid circulation circuits (3, 4) are at this stage characterized by an internal pressure equal to the working pressure. The pressure in secondary circuit 4 is still lower than the threshold pressure that would allow the safety valve at radial aperture 16 to open. Said safety valve is still closed because in drilling element 14 there is an internal pressure that prevents it from opening. For these reasons, mud circulation is still occurring through main circuit 3 only.

Once secondary circuit 4 has been pressurized, all conditions exist which allow starting the circulation via said secondary circuit 4.

The step of starting lateral circulation via secondary circuit 4 can thus be carried out. In this step, also the second valve 71B of the second sub-circuit 7 is opened, so that both the first valve 71A and the second valve 71B will be open. In fluid circulation system 2, while a fluid flow "P" is conducted towards the bottom of the well "H" a combination of circulation from above, via main circuit 3, and lateral circulation, via secondary circuit 4, as shown by way of example in FIG. 5B.

The rate of fluid flow "P" at the bottom of drilling well "H" is constant and equal to that on the delivery side of main pump 32, but it is divided into a part that is conveyed via main circuit 3 and a part that is conveyed via secondary circuit 4.

The combination of the two circulations without any interruption or reduction in the rate of the fluid flow at the bottom of well "H" allows keeping the working conditions at the bottom of well "H" unchanged compared to those obtainable during the previously described drilling step.

The step of closing and draining main circuit 3 is then carried out. In this step there is a definitive switching to lateral circulation via secondary circuit 4. In particular, in this step the first valve 62A of the first sub-circuit 6 is closed. When the first valve 62A closes, the whole fluid flow delivered by main pumps 32 will run into the second sub-circuit 7 and then into secondary circuit 4 towards radial aperture 16.

The closing of the first valve 62A of the first sub-circuit 6 is immediately followed by the activation of the first depressurization circuit 63; in particular, the third valve 62C opens and allows the pressure in the second portion 3B of main circuit 3 to be released. When the third valve 62C opens, the safety valve in the axial duct of drilling element 14 will close, as is known to those skilled in the art.

When the safety valve in the axial duct of drilling element 14 closes, full lateral circulation of fluid flow "P" will be attained via said secondary circuit 4.

Figure 6:
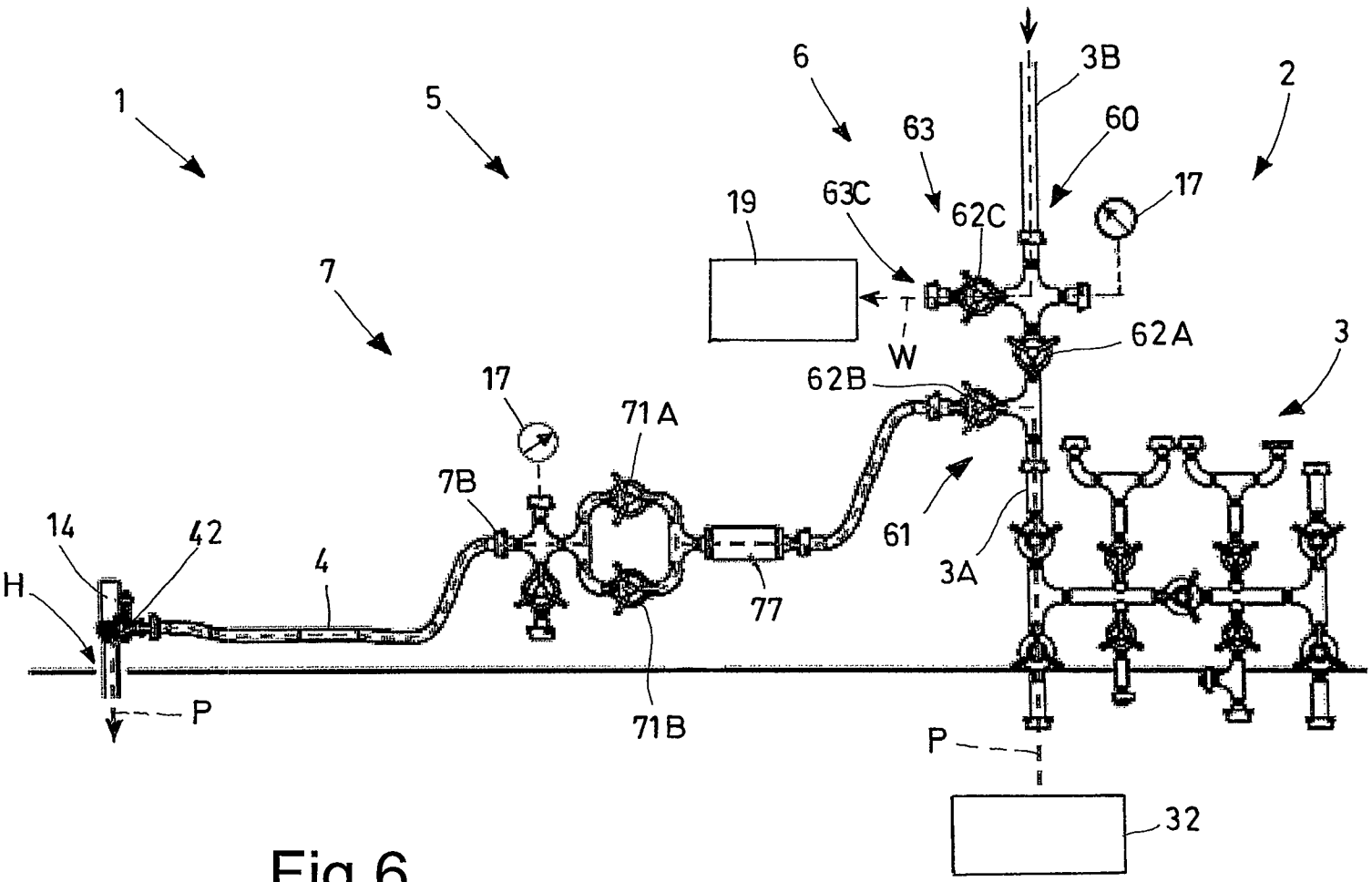
FIG. 6 shows the drilling rig when the fluid circulation system and the collector circuit are in an operating configuration wherein the collector circuit closes and then depressurizes the main circuit of the fluid circulation system; in particular, continuous circulation of the fluid flow towards the bottom of the drilling well only occurs via said secondary circuit.

The whole fluid flow "P" runs in secondary circuit 4 towards the bottom of drilling well "H", while main circuit 3, downstream of the first sub-circuit 6, is at a pressure close to ambient pressure, as shown by way of example in FIG. 6.

Once lateral circulation has been established, circulation of the fluid at a constant flow rate is ensured at the bottom of drilling well "H". In this step, main circuit 3, in the second portion 3B thereof towards top drive 12, is disconnected from the circulation towards well "H".

Figure 7:
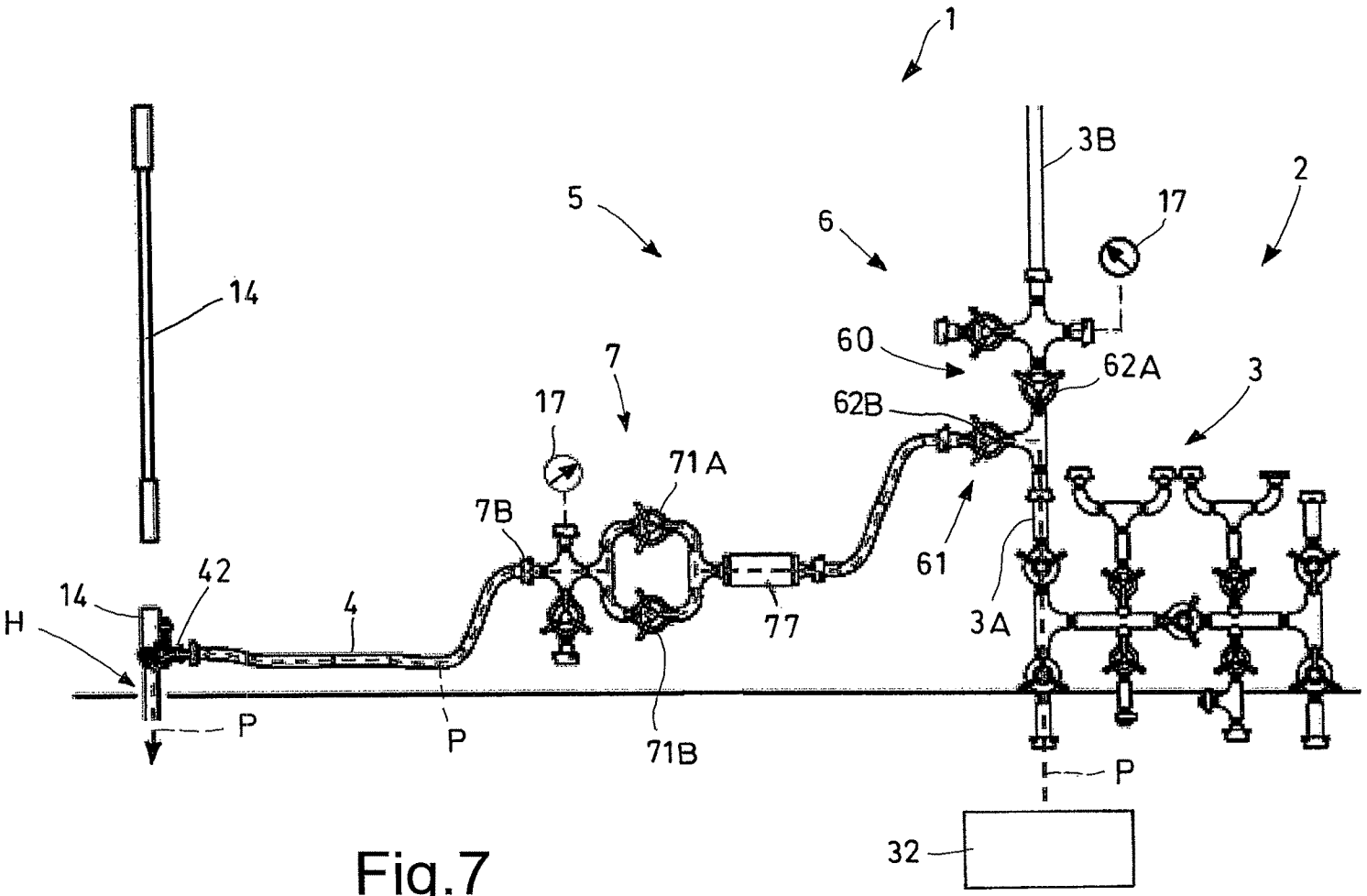
FIG. 7 shows the drilling rig when the fluid circulation system and the collector circuit are in an operating configuration wherein circulation of the fluid flow via said secondary circuit continues for a desired time, e.g. for adding a plurality of drill pipes.
Figure 8:
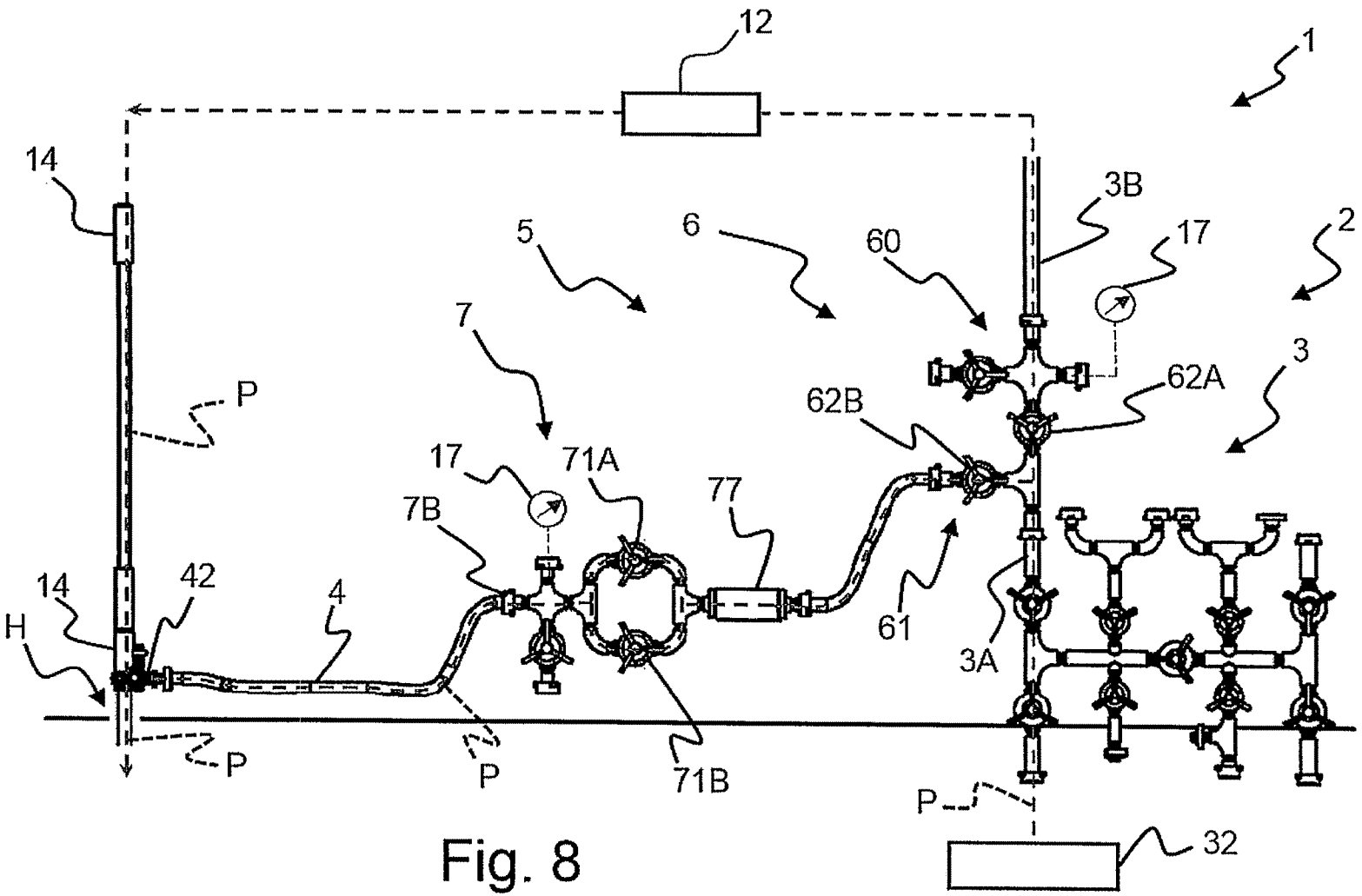
FIG. 8 shows the drilling rig when the fluid circulation system and the collector circuit are in an operating configuration wherein the collector circuit re-establishes, at least partially, the circulation of the fluid flow towards the main circuit.

It is therefore possible to disconnect top drive 12 from the plurality of drilling elements 14 in drilling well "H", which have just been used in the drilling step, and go on with the normal sequence of steps for adding one or more drilling elements 14 having the desired drill length, as is known to those skilled in the art, and as shown by way of example in FIG. 7.

After one or more new drilling elements 14 have been added, the step of opening main circuit 3 again can be carried out. This step comprises steps that allow restoring the circulation of fluid flow "P" towards top drive 12 via main circuit 3.

In the first step, the first valve 62A of the first sub-circuit 6 is opened to allow feeding main circuit 3 towards top drive 12.

Within main circuit 3, downstream of the first sub-circuit 6, the normal working pressure is established, resulting in a partial opening of the safety valve in the axial aperture of drilling element 14 connected to top drive 12. This partial opening of the safety valve in the axial aperture of drilling element 14 will allow the fluid to circulate again through main circuit 3, as shown by way of example in FIG. 8.

In this step, as in the step of starting lateral circulation, both circulations occur, i.e. lateral circulation and circulation through top drive 12. The rate of fluid flow "P" entering the set of drilling elements 14 still remains unchanged compared to the previous steps, and equal to that delivered by main pump 32, thus allowing the conditions at the bottom of drilling well "H" to be kept unchanged during the diversions of fluid flow "P".

Once the feeding of main circuit 3 towards top drive has been restored, the step of closing and draining secondary circuit 4 can be carried out.

During the closing step, the second valve 62B of the first sub-circuit 6 is closed. The third valve 71C of the second depressurization circuit 73 opens immediately afterwards, putting the same sub-circuit 7 and the secondary circuit 4 into communication with the fluid recovery circuit 19, thereby allowing the pressure in the second sub-circuit 7 and in the secondary circuit 4 to be released. The depressurization of the secondary circuit 4 will allow the safety valve comprised in radial aperture 16 of drilling element 14 to close.

Figure 9:
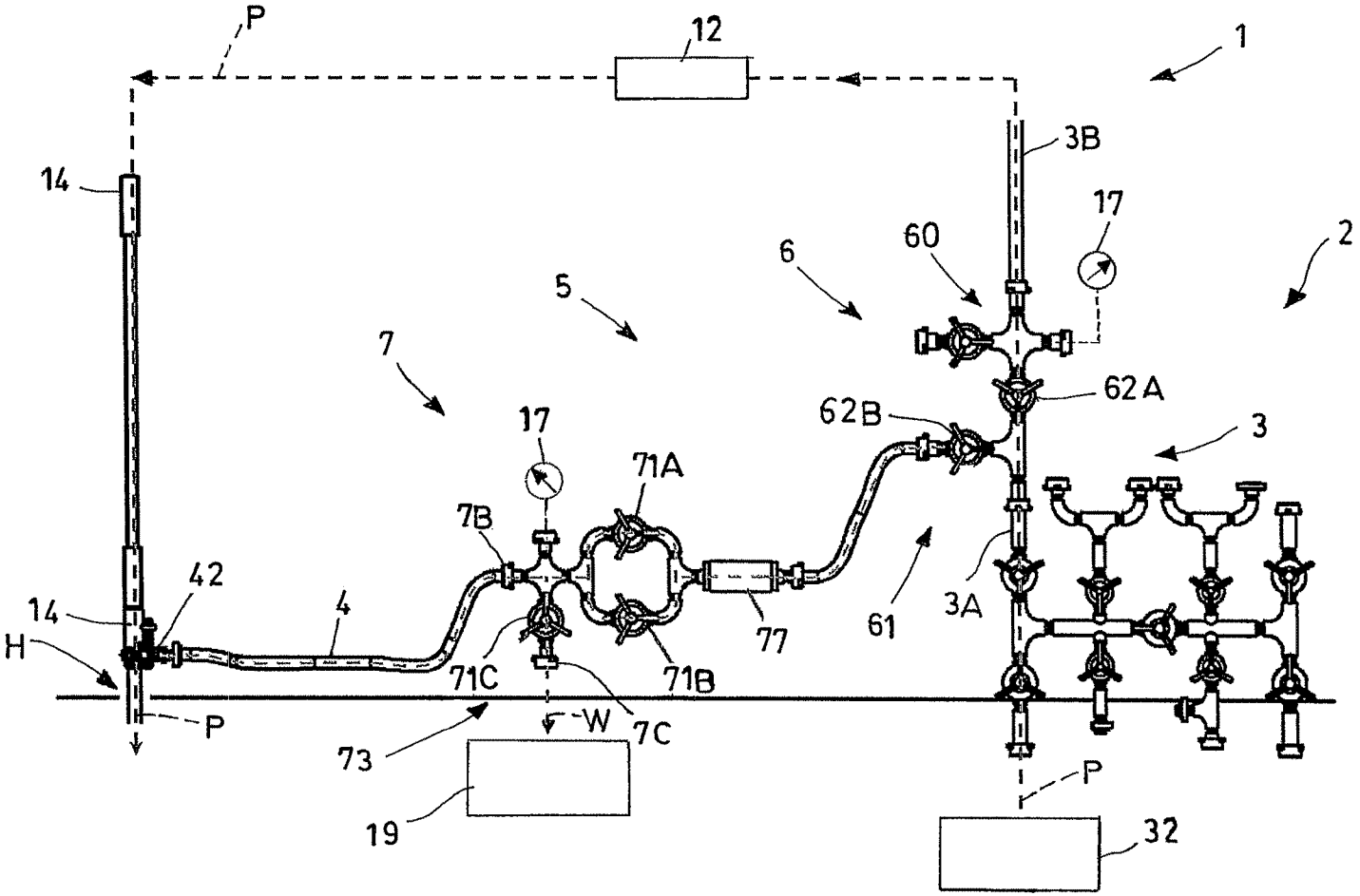
FIG. 9 shows the drilling rig when the fluid circulation system and the collector circuit are in an operating configuration wherein the collector circuit closes and then depressurizes the secondary circuit of the fluid circulation system, while circulation of the fluid flow towards the bottom of the drilling well continues via said main circuit.

The draining of the second sub-circuit 7 and of secondary circuit 4 is achieved by keeping the first valve 71A and the second valve 71B of the second sub-circuit 7 open to convey into fluid recovery circuit 19 the fluid that is present both upstream and downstream of the third valve 71C of the second depressurization circuit 73, as shown by way of example in FIG. 9.

Once secondary circuit 4 and second sub-circuit 7 have been drained, the step of removing and decoupling coupling device 42 can be carried out, as shown by way of example in FIG. 10. After this step, the normal activities of the previously described drilling step can be resumed by turning on the rotation of top drive 12.

The above-described steps can be implemented thanks to collector circuit 5 according to the present invention.

During this step, all valves comprised in the second sub-circuit 7 are closed.

Collector circuit 5 according to the present invention allows the fluid circulation steps to be executed continuously during the various operating steps of drilling rig 1.

Collector circuit 5 according to the present invention allows the second sub-circuit 7 to be always excluded from fluid feeding circuit 2 during the drilling steps of drilling rig 1, as previously described. This feature aims at:

- allowing maintenance of sub-circuit 7 without interrupting the drilling operations of drilling rig 1;
- facilitating the operations of coupling and decoupling secondary circuit 4 to radial aperture 16; and
- improving all safety-related aspects.

In addition to allowing depressurization of respective circuits (3, 4), the depressurization circuits (63, 73) comprised in collector circuit 5 are very important because they regulate the opening and closing of the axial and radial safety valves of drilling elements 14 during the diversions of fluid flow "P".

As a whole, fluid circulation system 2 comprising collector circuit 5 according to the present invention can be monitored by an operator responsible for drilling rig 1. The fluid circulation system can be checked, for example, by monitoring the two pressure measuring devices 17, e.g. pressure gauges, that detect the pressure at the outlet of the two sub-circuits (6,7) of collector circuit 5, and hence in main circuit 3, downstream of the first sub-circuit 6, and in secondary circuit 4, downstream of the second sub-circuit 7. Such pressure measuring devices 17 make available to the operator, e.g. through a display, the pressure values in each sub-circuit (6,7) of collector circuit 5.

Fluid circulation circuit 2 comprising collector circuit 5 according to the present invention allows main pumps 32 to be kept always on for the circulation of the drilling fluids, while keeping the pressure of the fluids injected at the bottom of drilling well "H" substantially constant during all of the operating steps of drilling rig 1.

Fluid circulation system 2 comprising collector circuit 5 according to the present invention can be used in drilling rigs 1 of the HP/HT (high pressure and high temperature) type or for deep-water drilling applications. Such types of drilling rigs are designed to work in particularly critical conditions, as is known to those skilled in the art.

Any other embodiments of the fluid circulation system and of the collector circuit not shown herein but intuitable by a man skilled in the art will have to be considered as falling within the protection scope of the present invention.

REFERENCE NUMERALS

Drilling rig 1
Top drive 12
Drilling element 14
Radial aperture 16
Pressure measuring device 17
Fluid recovery circuit 19
Fluid circulation system 2
Main circuit 3
First portion 3A
Second portion 3B
Main pump 32
Secondary circuit 4
Coupling device 42
Collector circuit 5
First sub-circuit 6
First duct 60
Inlet 60A
First outlet 60B
Second duct 61
Second outlet 61B
First valve 62A
Second valve 62B
Third valve 62C
First depressurization circuit 63
Third outlet 63C
Second sub-circuit 7
Inlet 7A
First outlet 7B
Second outlet 7C
First valve 71A
Second valve 71B
Third valve 71C
First fitting 72A
Second fitting 72B
Second depressurization circuit 73
Filtering device 77
Drilling well H
First fluid flow P
Second fluid flow W

The invention claimed is:

1. A collector circuit for intercepting and selectively diverting, at least partially, a fluid flow, which is continuously flowing in a fluid circulation system directed to the bottom of a drilling well through drilling pipes, for drilling rigs;

said collector comprises:

a first sub-circuit comprising:

at least one first duct, comprising at least one first valve, and at least one second duct, comprising at least one second valve;

at least one second sub-circuit;

said first sub-circuit, depending on the operating configuration of said at least one first valve and said at least one second valve, is adapted to:

allow the transit of said fluid flow in said at least one first duct, and selectively divert at least one portion of said fluid flow towards said at least one second duct;

said at least one second sub-circuit is fluid-dynamically connected to said at least one second duct of the first sub-circuit for receiving at least one portion of the fluid flow, diverted by said first sub-circuit, and directing the at least one portion of the fluid flow towards at least one first outlet of the second sub-circuit;

said at least one second sub-circuit and said first sub-circuit are independent of each other, and said at least one second sub-circuit is removable from the collector circuit;

wherein:

said at least one second sub-circuit comprises at least one valve for regulating said at least one portion of fluid flow directed towards said at least one first outlet;

said first sub-circuit comprises at least one first depressurization circuit;

said second sub-circuit comprises at least one second depressurization circuit;

said first depressurization circuit is independent of said second depressurization circuit.

2. The collector circuit according to claim 1, wherein in a first operating configuration of the first sub-circuit, said first valve and said second valve allow transit of said fluid flow in the first duct;

in at least a second operating configuration of the first sub-circuit, said first valve and said second valve divert at least one portion of fluid flow towards the second duct, and towards the second sub-circuit;

in a third operating configuration of the first sub-circuit, said at least one first valve and said at least one second valve divert the whole fluid flow towards the second duct, and towards the second sub-circuit.

3. The collector circuit according to claim 1, wherein said at least one second sub-circuit comprises a first valve and a second valve arranged in parallel to each other, both the first valve and the second valve are used for regulating said at least one portion of fluid flow directed towards said at least one first outlet.

4. The collector circuit according to claim 1, wherein said at least one second sub-circuit is independent of said first sub-circuit and is separable and/or excluded from said first sub-circuit when the first sub-circuit is in a first operating configuration, wherein said at least one first valve and said at least one second valve allow transit of said fluid flow solely in said first duct of the first sub-circuit.

5. The collector circuit according to claim 1, wherein said first sub-circuit comprises:

at least one inlet and at least one first outlet, connected by said first duct;

at least one second outlet comprised in said second duct, towards which at least one portion of the fluid flow is diverted.

6. The collector circuit according to claim 1, wherein said at least one first depressurization circuit comprises:

at least one further outlet connectable to a fluid recovery circuit of the drilling rig; and at least one third valve for regulating a second fluid flow directed towards said at least one further outlet.

7. The collector circuit according to claim 1, wherein said at least one second depressurization circuit comprises:

at least one second outlet connectable to a fluid recovery circuit of the drilling rig; and at least one third valve for regulating a second fluid flow directed towards said at least one second outlet.

8. Collector circuit according to claim 1, wherein said at least one second sub-circuit comprises at least one filtering device for filtering, at least partially, the fluid flowing in said second sub-circuit.

9. A fluid circulation system for continuously feeding a fluid flow to the bottom of a drilling well through drilling pipes being made by a drilling rig;

said circulation system comprises:

a main circuit, in which said fluid flow runs, comprising at least one main pump, said main circuit being adapted to be connected to a top drive of a drilling rig;

at least one secondary circuit, in which said fluid flow may run, adapted to be connected to a radial aperture comprised in drilling pipes of the drilling rig;

a collector circuit for intercepting said first flow circulating in said main circuit and diverting said first flow towards said at least one secondary circuit, for obtaining continuous circulation of the fluid flow towards the bottom of a drilling well through drilling pipes;

wherein said collector circuit comprises:

a first sub-circuit comprising:

at least one first duct, comprising at least one first valve, and at least one second duct, comprising at least one second valve;

at least one second sub-circuit comprising at least one valve for regulating said at least one portion of fluid flow directed towards at least one first outlet;

said first sub-circuit, depending on the operating configuration of said at least one first valve and said at least one second valve, is adapted to: allow transit of said fluid flow in said at least one first duct, and selectively divert at least one portion of said fluid flow towards said at least one second duct;

said at least one second sub-circuit is fluid-dynamically connected to said at least one second duct of the first sub-circuit for receiving at least one portion of the fluid flow, diverted by said first sub-circuit, and directing the at least one portion of the fluid flow towards said at least one first outlet of the second sub-circuit;

said at least one second sub-circuit and said first sub-circuit are independent of each other, and said at least one second sub-circuit is removable from the collector circuit.

10. The fluid circulation system according to claim 9, wherein said first sub-circuit is interposed between a first portion and a second portion of the main circuit; and said secondary circuit is adapted to be mechanically connected to the radial aperture through a connection device.

11. Process for continuous circulation of a fluid flow towards the bottom of a drilling well through drilling pipes; said fluid flow running in a fluid circulation system comprised in a drilling rig;

the process comprising the following steps:

a) intercepting the pressurized fluid flow running in a main circuit comprised in the fluid circulation system;

b) diverting the pressurized fluid flow, at least partially, towards at least one secondary circuit comprised in the system;

c) interrupting the circulation of the fluid flow towards said main circuit;

d) depressurizing said main circuit;

e) maintaining the circulation of the fluid flow in the secondary circuit for a desired time;

f) restoring, at least partially, the circulation of the pressurized fluid flow towards the main circuit;

g) interrupting the circulation of fluid flow towards said secondary circuit;

h) depressurizing said secondary circuit;

i) maintaining the circulation of the fluid flow in the main circuit for a desired time;

wherein said steps are carried out through a fluid circulation system, comprising a collector circuit, according to claim 10.

12. The process according to claim 11, wherein:

step a) of intercepting the fluid flow comprises a first step of opening at least one second valve of a first sub-circuit, while keeping the valves of a second sub-circuit closed;

step b) of diverting, at least partially, the fluid flow comprises:

a first operating step of opening at least one valve of the second sub-circuit, allowing the secondary circuit to be pressurized; and a second operating step of opening both valves of the second sub-circuit, allowing the fluid flow to run under pressure in said secondary circuit.

13. The process according to claim 11, wherein:

step c) of interrupting the circulation comprises an operating step of closing a first valve of the first sub-circuit, while keeping said second valve open;

step d) of depressurizing comprises an operating step of activating a first depressurization circuit of the first sub-circuit.

14. The process according to claim 11 wherein:

step f) of restoring the fluid flow comprises an operating step of opening said first valve, while keeping said at least one valve of the second sub-circuit open;

step g) of interrupting the circulation comprises an operating step of closing said second valve of the first sub-circuit, allowing the fluid flow to run under pressure in said main circuit;

step h) of depressurizing comprises an operating step of activating a second depressurization circuit of the second sub-circuit.

* * * * *